US005884421A

United States Patent [19]

Key

[11] Patent Number: 5,884,421

[45] Date of Patent: Mar. 23, 1999

[54] APPARATUS AND METHOD FOR CONSTRUCTING A ROTATABLE LABEL DEVICE

[76] Inventor: Stephen M. Key, 10212 Whitetail Dr., Oakdale, Calif. 95361

[21] Appl. No.: 741,607

[22] Filed: Oct. 31, 1996

Related U.S. Application Data

[63] Continuation of Ser. No. 597,854, Feb. 7, 1996.

[51] Int. Cl.[6] ..... G09F 3/00

[52] U.S. Cl. ..... 40/306; 40/310; 40/506

[58] Field of Search ..... 40/306, 310, 312, 40/506, 324; 206/459.5, 524.2; 220/438; 215/252, 256, 250, 901

[56] References Cited

U.S. PATENT DOCUMENTS

| | | | |
|---|---|---|---|
| 736,035 | 8/1903 | Stevenson . | |
| 1,064,576 | 6/1913 | Washburn . | |
| 1,312,611 | 8/1919 | Chess . | |
| 1,334,031 | 3/1920 | Hahn . | |
| 1,387,625 | 8/1921 | Stein . | |
| 1,486,313 | 3/1924 | Antwerp . | |
| 2,013,616 | 9/1935 | Rettenmeyer . | |
| 2,129,364 | 9/1938 | Simons et al. . | |
| 2,441,607 | 5/1948 | Walls . | |
| 2,468,000 | 4/1949 | Taylor . | |
| 2,504,076 | 4/1950 | Lindblom . | |
| 2,844,893 | 7/1958 | Keller . | |
| 2,860,431 | 11/1958 | Barnum . | |
| 2,931,657 | 4/1960 | Lewis . | |
| 2,935,814 | 5/1960 | Freeze . | |
| 2,971,283 | 2/1961 | Parker . | |
| 3,278,182 | 10/1966 | Lescher . | |
| 3,374,911 | 3/1968 | White . | |
| 3,488,880 | 1/1970 | Taylor . | |
| 3,542,229 | 11/1970 | Beyerleda . | |
| 3,604,584 | 9/1971 | Shank . | |
| 3,733,002 | 5/1973 | Fujio . | |
| 3,960,713 | 6/1976 | Carey . | |
| 4,044,889 | 8/1977 | Orentreich . | |
| 4,203,240 | 5/1980 | Goodwin | 40/310 |
| 4,381,615 | 5/1983 | Lonsmin . | |
| 4,405,045 | 9/1983 | Villa-Real . | |
| 4,505,497 | 3/1985 | Katzman . | |
| 4,567,681 | 2/1986 | Fumei . | |
| 4,658,974 | 4/1987 | Fujita et al. . | |
| 4,724,973 | 2/1988 | Shah | 215/246 |
| 4,877,119 | 10/1989 | Hosking . | |
| 5,076,613 | 12/1991 | Kovacs . | |
| 5,154,448 | 10/1992 | Griffin et al. . | |
| 5,324,559 | 6/1994 | Brombacher . | |
| 5,342,093 | 8/1994 | Weernink . | |
| 5,403,636 | 4/1995 | Crum . | |
| 5,727,766 | 3/1998 | Mayo | 40/772 |

FOREIGN PATENT DOCUMENTS

| | | | |
|---|---|---|---|
| 85214 | 3/1958 | Denmark . | |
| 285514 | 10/1988 | European Pat. Off. | 40/102 |
| 965522 | 9/1950 | France | 40/665 |
| 1347102 | 11/1963 | France . | |
| 2460260 | 1/1981 | France . | |
| 2677786 | 12/1992 | France . | |
| 1565 | 6/1888 | Sweden . | |

*Primary Examiner*—Cassandra H. Davis
*Attorney, Agent, or Firm*—Carr & Ferrell LLP

[57] ABSTRACT

An apparatus and method for constructing a rotatable label device and attaching it to a container. The rotatable label device includes an inner shell and an outer shell concentrically and rotatably mounted to the inner shell. Either the container, the inner shell or the outer shell may include a set of rims for limiting the movement of the outer shell along the axis of the container. These rims may be created by gluing panels, folding, embossing or by detaching perforated sections of an outer label. The rotatable label device may be attached to the container in one-step by first tacking the inner label to the outer label, mounting the combined unit and then separating the inner label from the outer label.

22 Claims, 35 Drawing Sheets

APPARATUS AND METHOD FOR CONSTRUCTING A ROTATABLE LABEL DEVICE

CROSS-REFERENCE TO RELATED APPLICATIONS

The present application is a continuation-in-part of U.S. Pat. application Ser. No. 08/597,854, filed Feb. 7, 1996, invented by Stephen M. Key, entitled "System And Method Using A Double-Walled Rotatable Device For Presenting Information On A Pharmaceutical Container." The subject matter is herein incorporated by reference.

BACKGROUND OF THE INVENTION

1. Field of the Invention

This invention relates generally to rotatable labels, and more particularly to an apparatus and method for constructing a rotatable label device.

2. Description of the Background Art

Presentation is a significant concern of artists, merchants, and consumers alike, since presentation can greatly enhance or diminish the effect of an intended message. In many cases, presentation techniques and the information are inseparable, making the presentation format equivalently important.

Information, including artwork, has been presented in a multitude of formats, ranging from the simple picture frame to modern electronic video displays. An important consideration in selecting a presentation format is the application and audience intended for the particular message. For example, commercial art uses advertising and product labeling to market a particular product to a consumer audience. Another consideration for artists, merchants and consumers is the cost of presenting the information. Expensive materials or state-of-the-art technologies can substantially add to the cost of the final product.

An effective and economical presentation format permits separate message elements to interact by physically changing position during viewing. Conventional attempts to economically present information using interacting elements have taken several approaches. An exemplary presentation device, as disclosed in U.S. Pat. No. 5,339,998, is formed by an inner cylindrical shell for containing a drinkable liquid, and an outer cylindrical shell concentric with the inner shell, wherein both shells are formed of transparent synthetic plastic material. The information is silk-screened on the inner shell, and decorative particles are placed in a liquid-filled chamber formed between the inner and outer shells. When a holder shakes the drinking vessel, the decorative particles float in front and enhance the effect of the artwork.

A second exemplary presentation device, as disclosed in U.S. Pat. No. 5,342,093, consists of a wrap-around label having a contact portion, an overlap portion, a transparent release coating and an adhesive coating. The overlap portion may be peeled away from the contact portion to expose the front surface of the contact portion.

A third exemplary presentation device, as disclosed in U.S. Pat. No. 5,154,448, consists of a layered scratch-off label for containers which includes a thin scratchable surface layer that can be scratched off to reveal a second layer underneath the surface layer.

A fourth exemplary presentation device, as disclosed in U.S. Pat. No. 2,860,431, consists of a can having a welded center section, a top coupled to the center section by a top bead, and a bottom coupled to the center section by a bottom bead. An inner label containing information is attached to the center section of the can. A rotatable outer sleeve with an opening is fitted around the inner label so that information on the inner label is viewable through the opening. The '431 patent's presentation device however has several limitations. First, if the can is very tall, a typical user will not be able to hold the top and bottom of the can between the user's thumb and forefingers of one hand while rotating the outer sleeve with the user's other hand. Second, the '431 patent does not disclose how to keep the outer sleeve securely in place if the top and bottom beads are not present on the can.

These presentation devices permit separate elements of the information to interact by physically changing positions. However, the usefulness of these devices is limited either because the viewer has little control over the interactive movement of the message elements or because manufacturing the devices is too expensive. Therefore, an improved apparatus and method is needed to present information on a container in a way that permits a greater degree of user-controlled interaction and that is more economical.

SUMMARY OF THE INVENTION

An apparatus and method are disclosed for constructing a rotatable label device and attaching it to a container. The rotatable label device includes an inner shell and a outer shell having a transparent region, wherein the outer shell is concentric to and rotatable with the inner shell. Background messages are applied to the outer surface of the inner shell, and foreground messages are applied to either surface of the outer shell, so long as they can be viewed from the outer surface of the outer shell. When the outer shell and inner shell are rotated with respect to each other, the foreground and background messages visibly interact. Either the container, the inner shell or the outer shell may be affixed with rims to limit movement of the shells along the container's axis. These rims may be formed on the container as part of the container's design. The rims may be formed on the shells by gluing strips to the shell, folding the shell's ends, or embossing the ends of the shell. Alternately, one of the shells could be perforated and glued to the other shell such that once the perforations are broken the rims are formed. To aid rotation of the outer shell about the inner shell, a grasping area may be provided on the container for a user to hold while rotating the outer shell.

Alternate embodiments of the present invention include an outer shell having multiple segments that are independently rotatable about the inner shell. The outer shell may or may not have windows. The outer shell's segments may be separated by perforations that remain intact as the outer shell is fitted about the container and separated when a user decides to rotate the segments independently. The inner shell may be attached to the outer shell with a permanently adhesive tacking substance, forming a combined shell. The combined shell may then be attached to the container in one step with a labeling machine such that the inner shell is permanently affixed to the container. Finally, perforations on the inner or outer shell are broken by a user, thus allowing the outer shell to rotate about the inner shell and the container.

Thus, the present invention provides an additional surface for information, which results in about 75% more space for advertisements, instructions, precautions, larger type, additional languages and the like.

DETAILED DESCRIPTION OF THE PREFERRED EMBODIMENT

The present apparatus is a double-walled rotatable presentation device which permits a user to control a visual interplay between separate layers of artwork. The device, generally illustrated as 10, includes one or more shells (i.e. rotatable label(s), preferably rotatably mounted on a container. The device 10 may be manufactured from any suitable material and is capable of many different embodiments, and can incorporate any information or graphic artwork or any other type of indicia. The information could include alphanumeric data alone or in conjunction with other types of graphic artwork. Further, the rotatable presentation device may be incorporated into a wide range of products as a unique feature of the product. In addition to purely aesthetic uses, the rotatable presentation device may be used for education, entertainment, pharmaceutical or utilitarian purposes.

Figure 1:
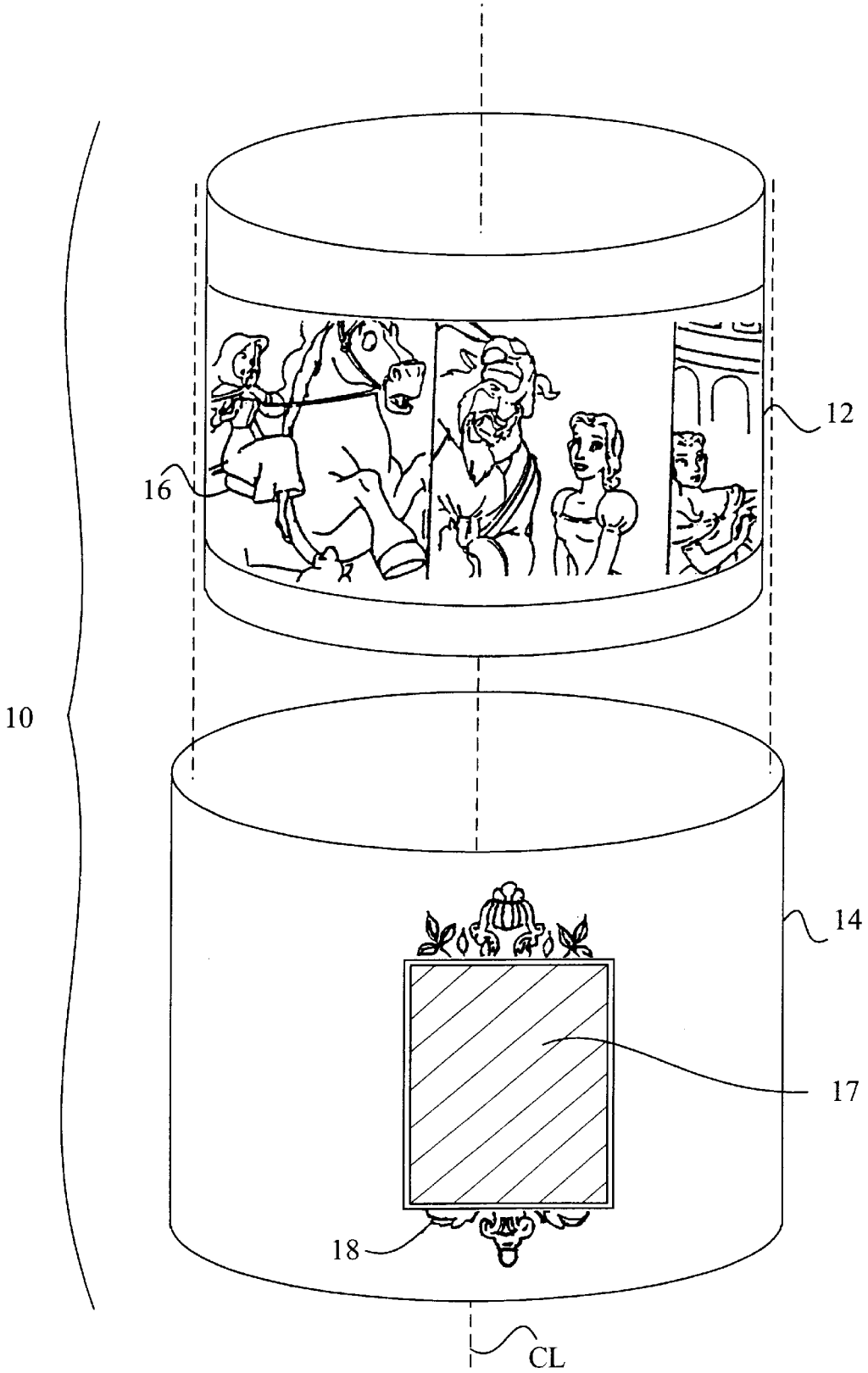
FIG. 1 is an exploded perspective view of a double-walled rotatable presentation device according to the present invention.

Referring now to FIG. 1, an exploded perspective view is shown of a double-walled rotatable presentation device 10 according to the present invention. Device 10 may be formed of any suitable material, including a flexible synthetic material such as polypropylene or an acrylic resin. Device 10 includes cylindrical inner shell 12 and transparent cylindrical outer shell 14. Inner shell 12 is dimensioned to fit concentrically around centerline axis CL and rotatably within outer shell 14. Background artwork 16 is attached to the outer surface of inner shell 12, and foreground artwork 18 is attached to either surface of transparent outer shell 14. The foreground and background information may be attached using any effective method, including a conventional silk-screening process.

Figure 2:
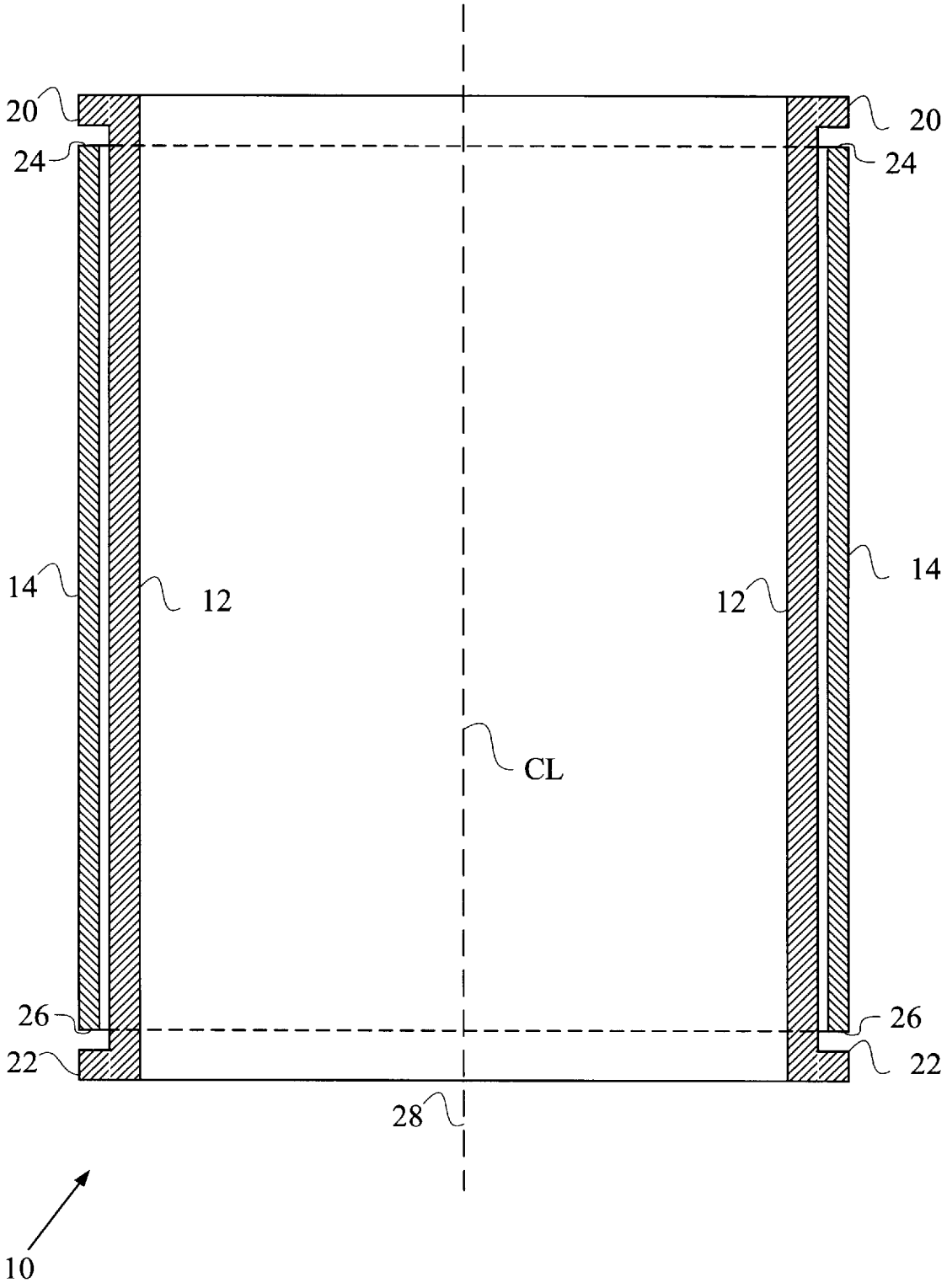
FIG. 2 is a longitudinal section view of a first double-walled rotatable presentation device.

Referring now to FIG. 2, a view of a section at a plane including the centerline through a first embodiment of the double-walled rotatable presentation device is shown. Inner shell 12 has an outer surface from the top of which protrudes an annular upper rim 20, and from the bottom of which protrudes an annular lower rim 22. The upper and lower ends of inner shell 12 may be open, closed or closeable. Outer shell 14 is positioned concentrically around inner shell 12 and has an upper end 24 forming a circular top opening and a lower end 26 forming a circular bottom opening. Outer shell 14 at its upper end 24 abuts or is stopped by the underside of upper rim 20, and at its lower end 26 abuts the topside of lower rim 22. Upper rim 20, at least in some arcs of its circumference, has an outside diameter greater than the inside diameter at upper end 24 of outer shell 14. Likewise, the lower rim 20 outside diameter is greater than the inside diameter at lower end 26 of outer shell 14. Upper rim 20 and lower rim 22 thereby capture and maintain outer shell 14 in a rotatable position concentric to inner shell 12. Inner shell 12 may have a closed bottom 28 enabling the rotatable presentation device 10 to be used as a container. Outer shell 14 may be formed of transparent synthetic material of good clarity to permit clear viewing of background artwork 16. Inner shell 12 may be formed of either transparent or opaque synthetic material.

Figure 3:
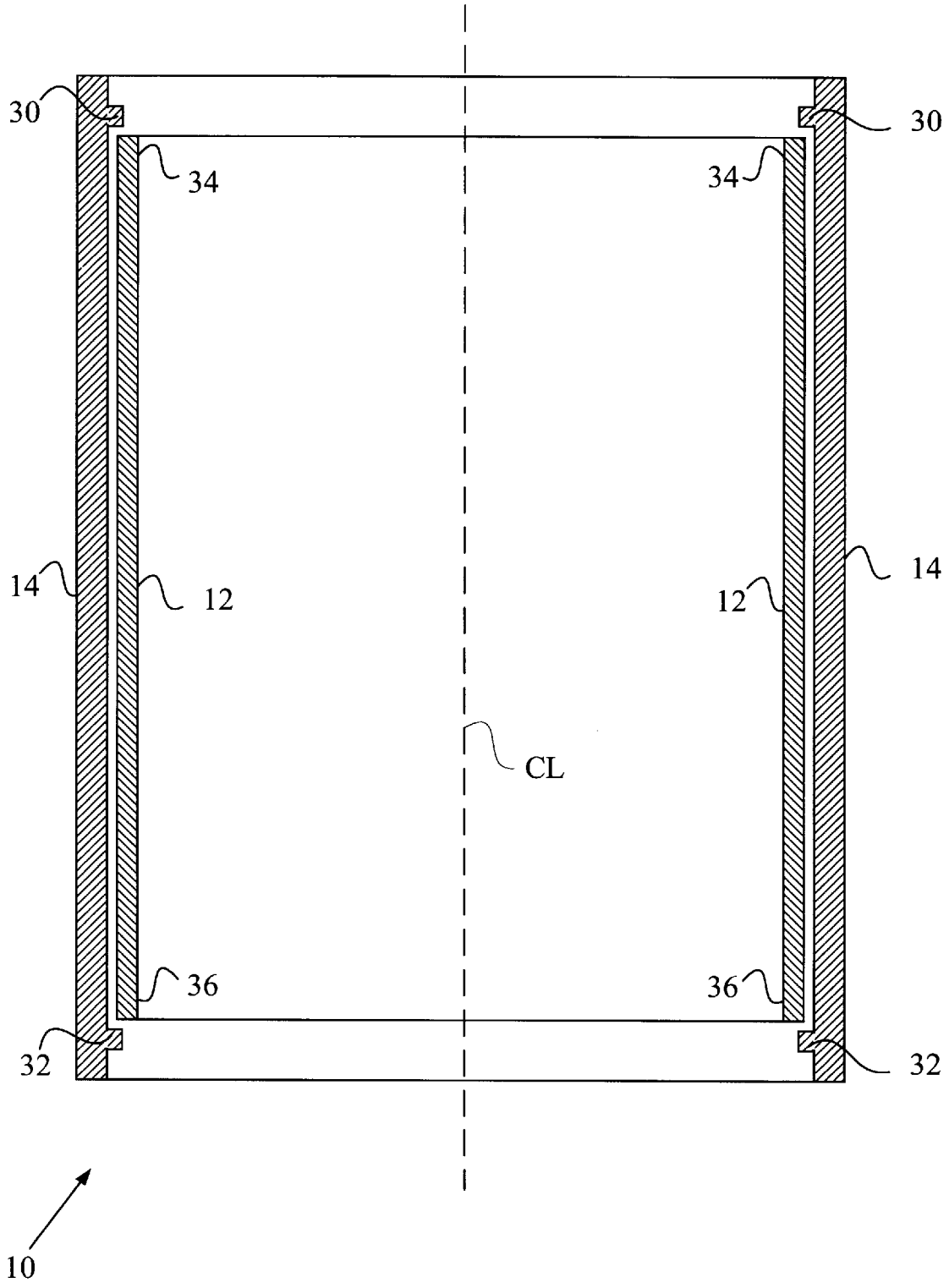
FIG. 3 is a longitudinal section view of a second double-walled rotatable presentation device.

Referring now to FIG. 3, a view of a section at a plane including the centerline through a second embodiment of the double-walled rotatable presentation device is shown. Outer shell 14 has an outer surface from the top of which protrudes an annular upper lip 30, and from the bottom of which protrudes an annular lower lip 32. The upper and lower ends of inner shell 12 may be open, closed or closeable. Inner shell 12 is positioned concentrically within outer shell 14 and has an annular upper portion 34 and an annular lower portion 36. Inner shell 12 at its upper portion 34 abuts or is stopped by the underside of upper lip 30, and at its lower portion 36 abuts the topside of lower lip 32. Upper lip 30, at least in some arcs of its circumference, has an inside diameter smaller than the outside diameter at upper portion 34 of inner shell 12. Likewise, the lower lip 30 inside diameter is smaller than the outside diameter at lower portion 36 of inner shell 12. Upper lip 30 and lower lip 32 thereby capture and maintain inner shell 12 in a rotatable position concentric to outer shell 14. Inner shell 12 may have a closed bottom 28 enabling rotatable presentation device 10 to be used as a container. Outer shell 14 may be formed of transparent synthetic material of good clarity to permit clear viewing of background artwork 16. Inner shell 12 may be formed of either transparent or opaque synthetic material.

Figure 4:
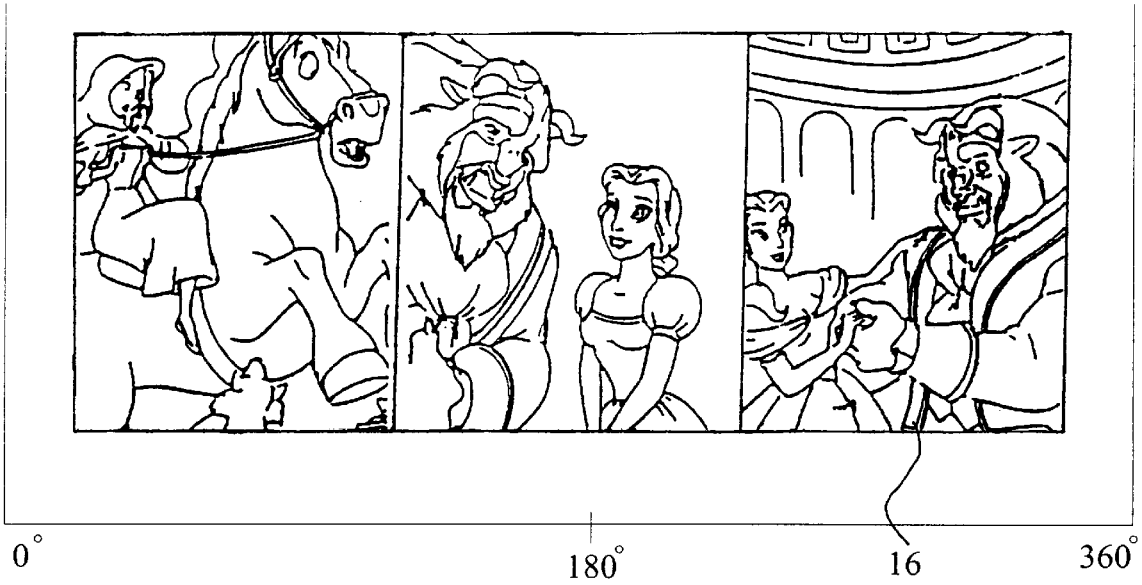
FIG. 4 is a planar projection of exemplary background artwork to be attached to the inner shell.

Referring now to FIG. 4, a planar projection of one embodiment of background artwork 16 to be attached to the outer surface of cylindrical inner shell 12 of presentation device 10 is shown. The FIG. 4 embodiment includes three panels or scenes from a story entitled, "The Beauty and the Beast." Background artwork 16 may be attached to or embedded in the outer cylindrical surface of inner shell 12 using any effective method, including conventional silk-screening techniques.

Figure 5:
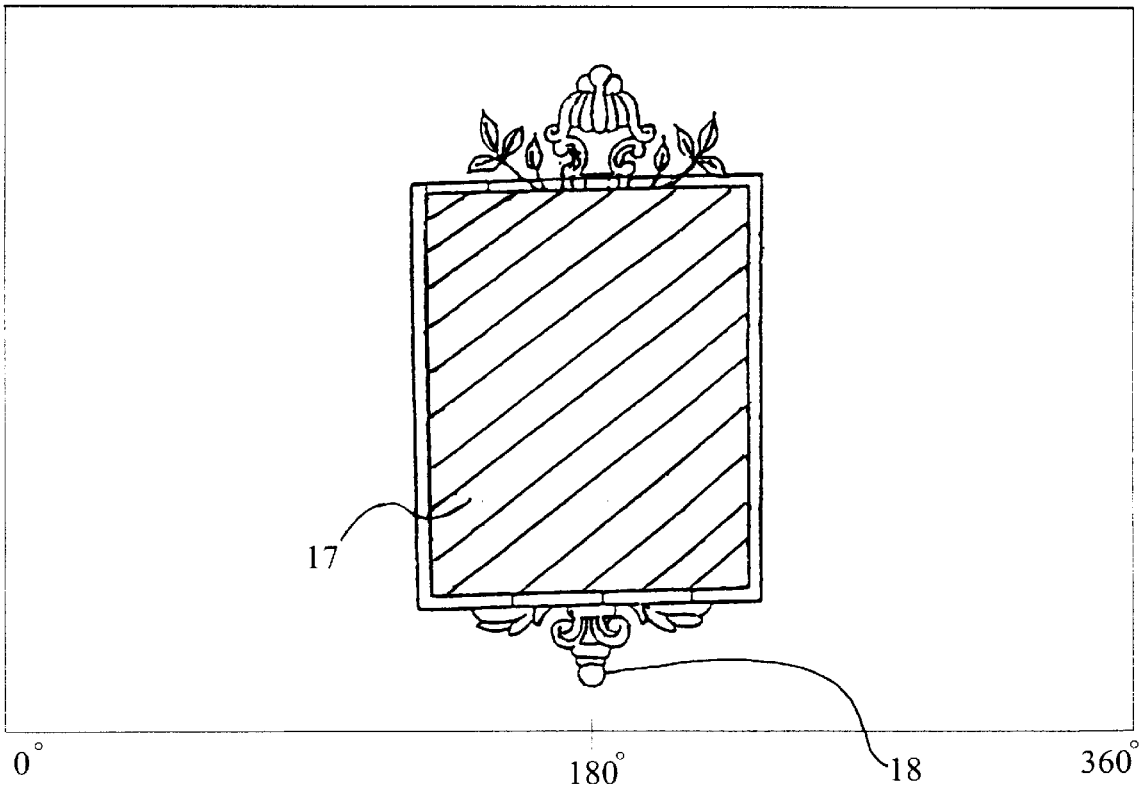
FIG. 5 is a planar projection of exemplary foreground artwork to be attached to the outer shell.

Referring now to FIG. 5, a planar projection of one embodiment of the foreground artwork 18 to be attached to the transparent cylindrical outer shell 14 of presentation device 10 is shown. Foreground artwork 18 includes an opaque background surrounding a picture frame surrounding a transparent window area 17. Transparent window area 17 is preferably a contiguous part of outer shell 14 and does not form a hole or aperture through outer shell 14, so that foreign objects and moisture are prevented from entering the area between inner shell 12 and outer shell 14. Foreground artwork 18 may be attached to or embedded in either the inner or outer cylindrical surface of transparent outer shell 14 using any effective method, including conventional silk-screening techniques.

Figure 6:
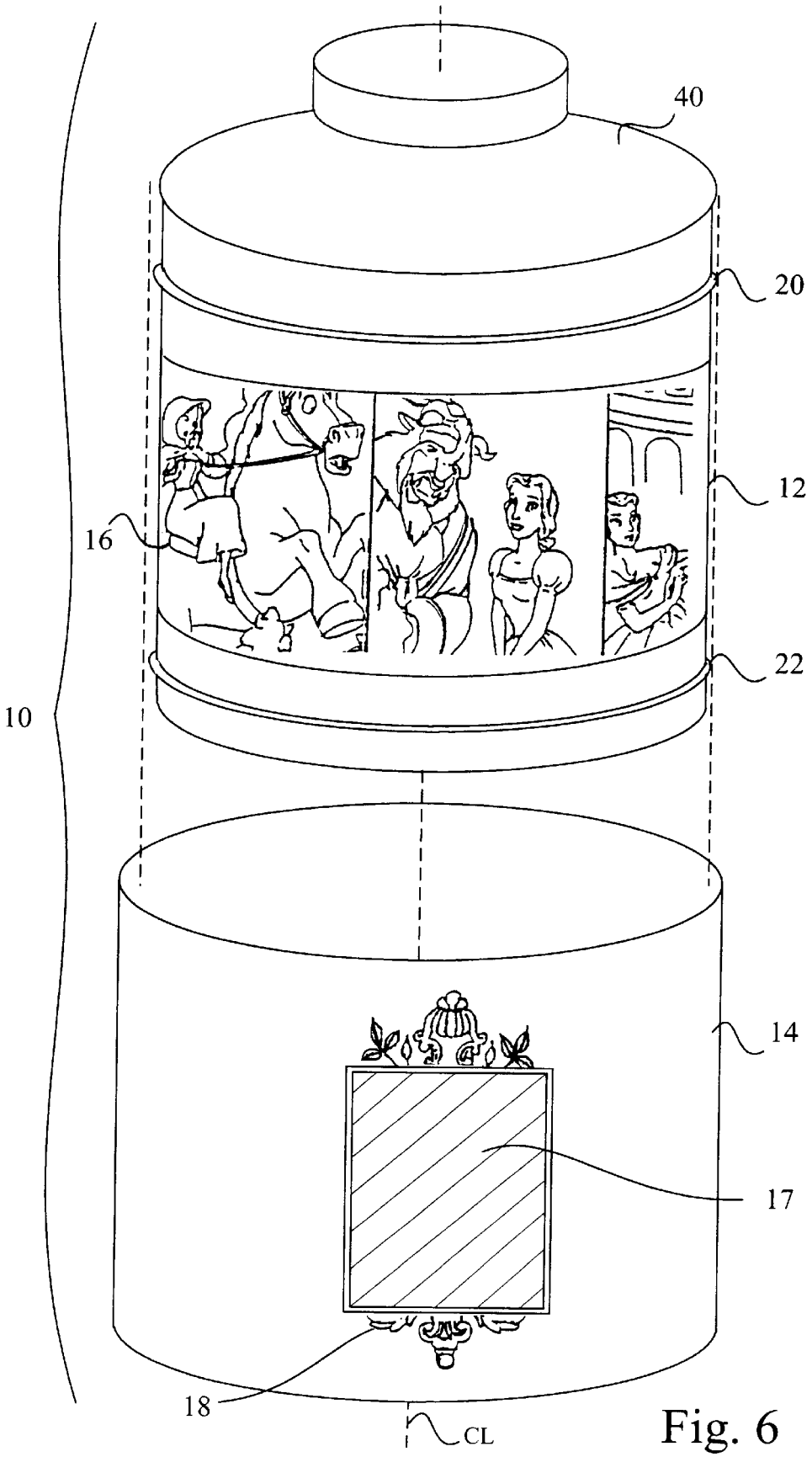
FIG. 6 is an exploded perspective view of the double-walled rotatable presentation device as a packaging label on the outer surface of a product container.

Referring now to FIG. 6, an exploded perspective view is shown of double-walled rotatable presentation device 10 used as a packaging label on the outer surface of a product container 40 according to one embodiment of the present invention. Although a cylindrical container is shown as a support for rotatable presentation device 10, objects having any size or shape may alternatively support presentation device 10. Inner shell 12 of rotatable presentation device 10 may be attached to the outer surface of product container 40 using any effective method, including conventional adhesive bonding materials, or inner shell 12 may be made integral with a container 40. In another embodiment, upper and lower rims 20 and 22 may be integral with container 40 and thereby capture and maintain both inner shell 12 and outer shell 14 in rotatable and concentric positions relative to each other. Presentation device 10 may also be attached to the outer surface of a given product by means of protrusions extending from the inner surface of inner shell 12 which are placed in contact with the outer surface of the given product and secure presentation device 10 to the given product. The protrusions may be in the form of concentric rings, knobs or any other suitable shape. Outer shell 14 may be positioned concentrically around inner shell 12 using any effective manufacturing method.

Figure 7:
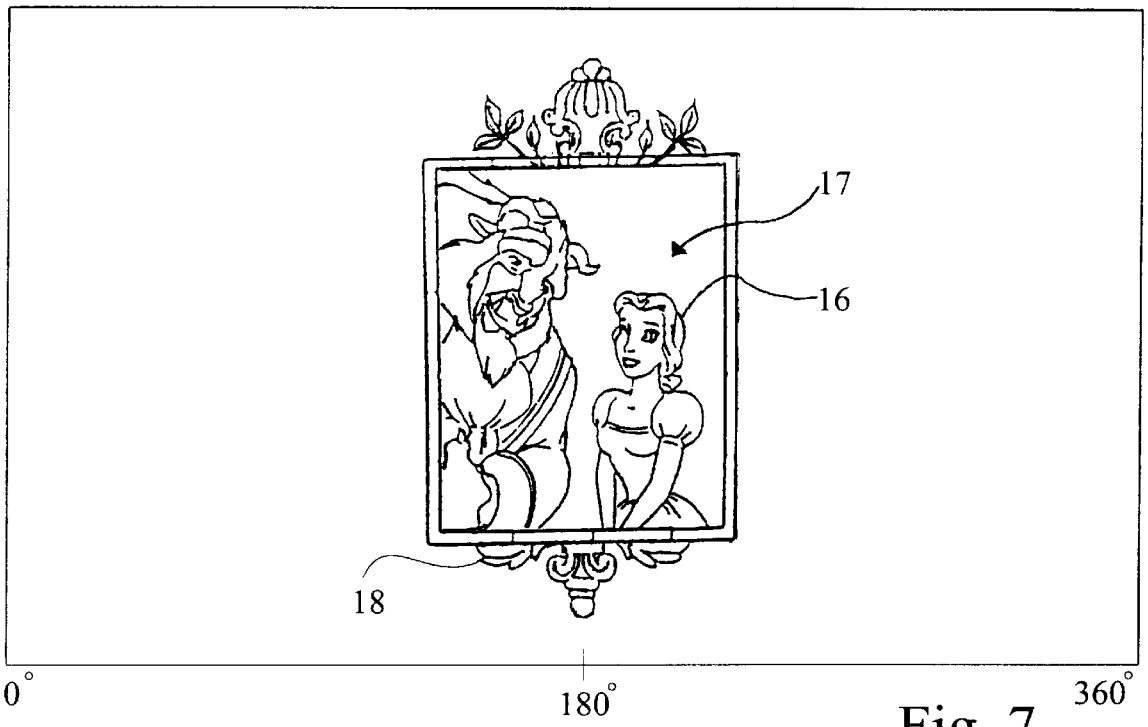
FIG. 7 is a planar projection of exemplary foreground information superimposed over background information to reveal the middle scene from the background information.

Referring now to FIG. 7, a planar projection of the FIG. 5 foreground artwork 18 superimposed over the FIG. 4. background artwork 16 is shown. Foreground artwork 18 has the picture frame-circumscribed transparent area 17 positioned to reveal the middle scene of background artwork 16.

Figure 8:
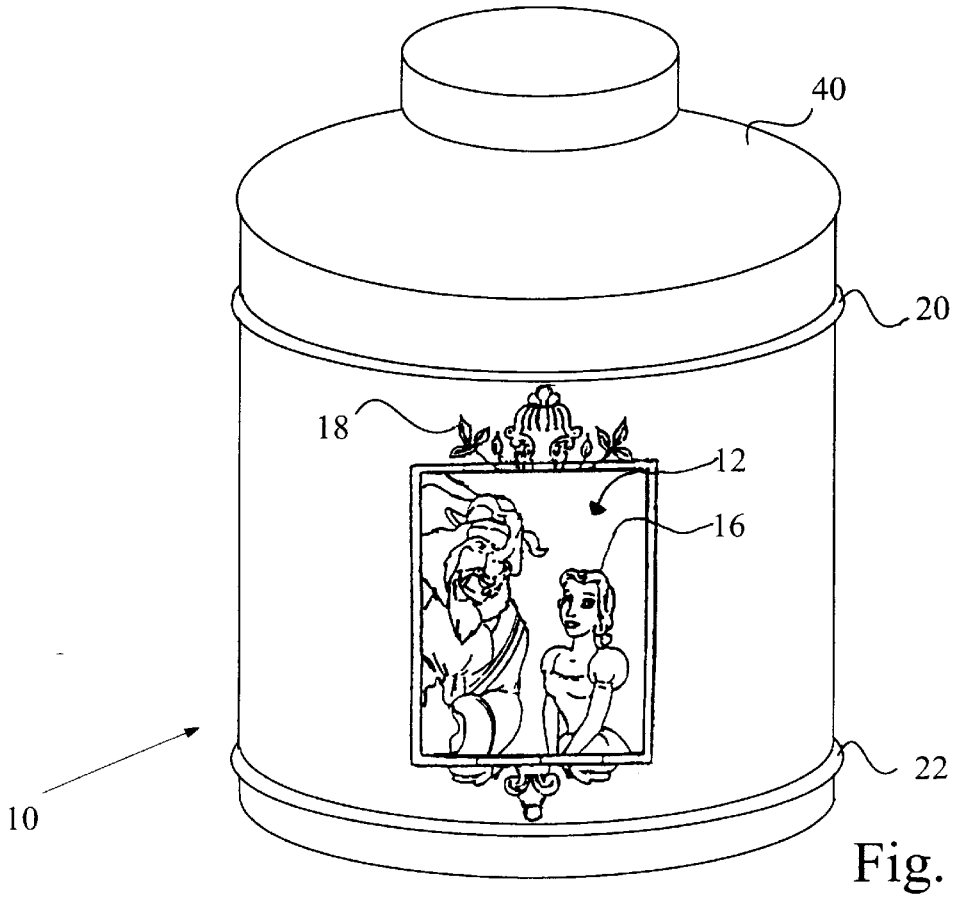
FIG. 8 is a perspective view of the double-walled rotatable presentation device as a packaging label on the outer surface of a product container with the foreground information concentrically and rotatably superimposed over the background information to reveal the middle scene from the background information.

Referring now to FIG. 8, a perspective view is shown of double-walled rotatable presentation device 10 used as a packaging label on the outer surface of a product container 40. Lower rim 22 and upper rim 20 hold outer shell 14 in position so that it can be rotated with respect to inner shell 12 to provide a product container 40 packaging label having separate, controllable and interacting elements of foreground artwork 18 and background artwork 16. Foreground artwork 18 as shown is concentrically and rotatably positioned around background artwork 16 as in FIG. 7 to reveal the middle scene from background artwork 16 through the transparent area circumscribed by the picture frame of foreground artwork 18. When the outer shell 14 of device 10 is rotated with respect to inner shell 12, foreground artwork 18 moves in relation to background artwork 16 and, inside the picture frame, reveals passing portions of the background artwork. A user can control this rotation movement to control the apparent interaction between foreground artwork 18 and background artwork 16 according to the present invention.

Figure 9:
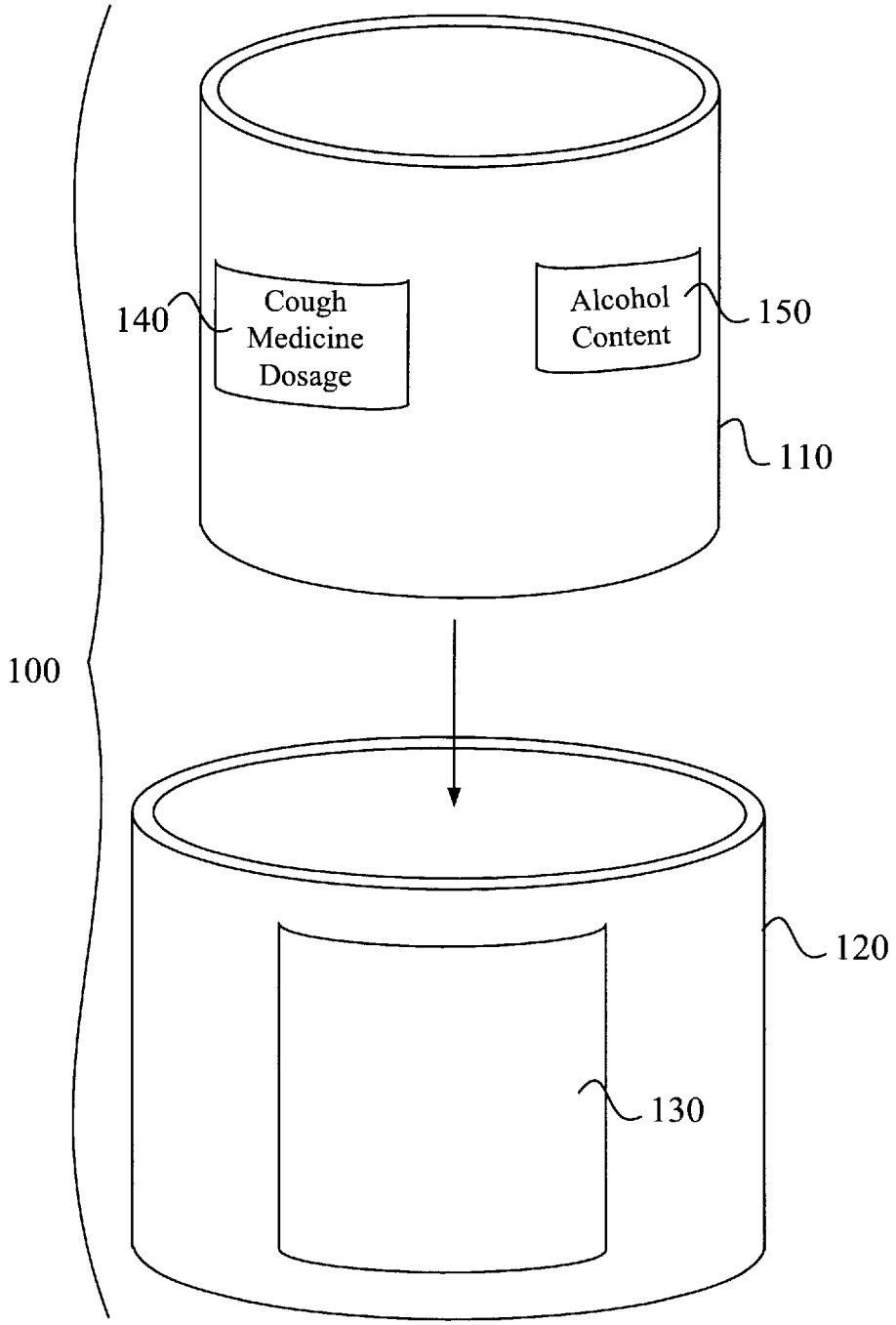
FIG. 9 is an exploded perspective view of a third double-walled rotatable presentation device.

Referring now to FIG. 9, an exploded perspective view of a third rotatable presentation device 100 is shown, in accordance with the present invention. One field of use which is benefited by the present invention is that of pharmaceutical packaging. Drug companies are required to include detailed product information with medications, and consumers are benefited by clear and detailed descriptions of the drugs purchased. The present invention advantageously provides additional labeling space for drug information, while simultaneously prioritizing information by having a first level of information on an outer surface and a second level of information on an inner label. While the first level of information on the outer label is always visible, the second label of information is only selectively visible as explained below. This prioritization of information enables great flexibility in the organization and presentation of product data. Although the description which follows is specific to pharmaceutical containers, the invention also applies effectively to a wide range of consumer and other products such as foods, cosmetics, and contained goods. Additionally, the preferred pharmaceutical embodiment anticipates the use of rotating labels; however, these labels can be genuinely thought of as rotating "shells" as described above and further discussed below.

Device 100 of FIG. 9 may be formed of any suitable material, including a flexible material such as polypropylene, acrylic resin or paper. Device 100 includes inner shell 110 and outer shell 120. Inner shell 110 can be either transparent or opaque, and is dimensioned to fit concentrically and rotatably within outer shell 120. The outer surface of inner shell 110 supports background messages, such as cough medicine dosage message 140 and alcohol content message 150. Either surface of outer shell 120 supports a foreground message (not shown) so long as the message is visible from the outer surface. The foreground and background messages may be attached using any effective technique, including conventional lithographic processes. Outer shell 120 preferably has a transparent region 130, so that a section of the background art located on inner shell 110 can be viewed through region 130. Alternatively, outer shell 110 can be totally transparent.

Figure 10:
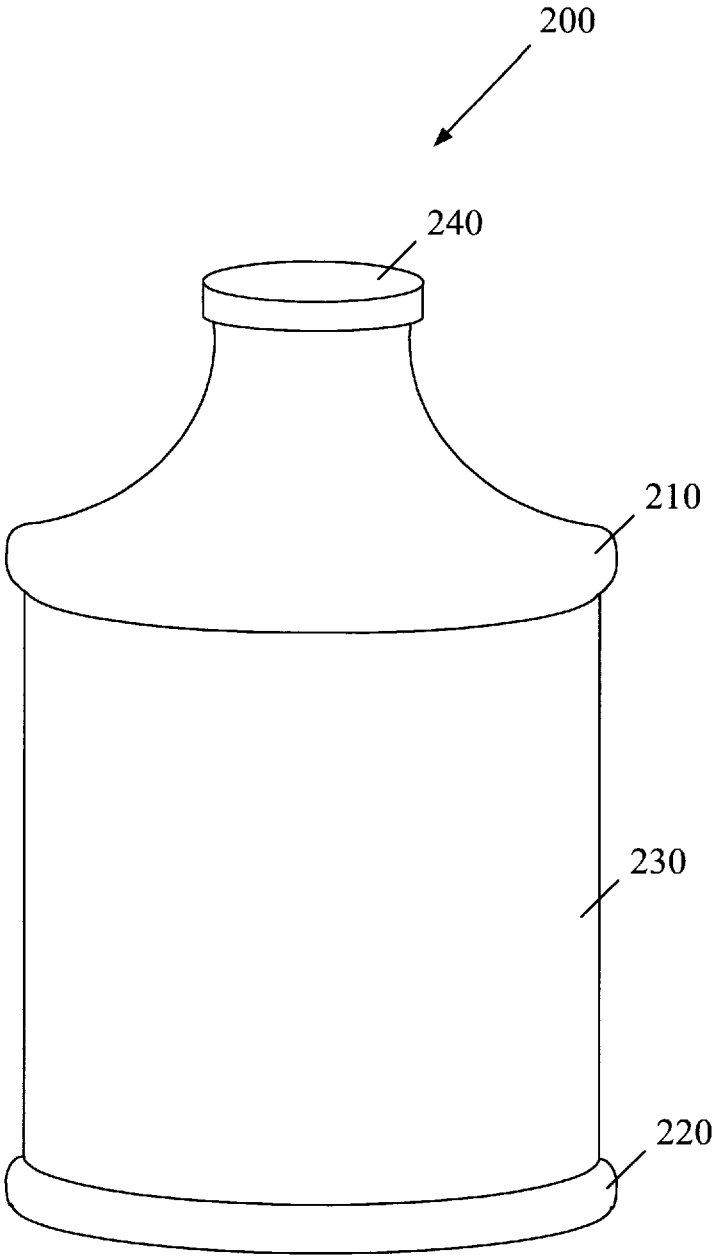
FIG. 10 is a perspective view of a pharmaceutical container having protruding upper and lower rims.

Referring now to FIG. 10, a perspective view of a preferred pharmaceutical container 200 for supporting presentation device 100 is shown. Container 200 is cylindrical and comprises an upper protruding rim 210, a lower protruding rim 220, a presentation device support surface 230 defined by protruding rims 210 and 220, and a cap 240. Although container 200 is shown as cylindrically shaped, the present invention can be implemented with any container having a presentation device support surface 230. Inner shell 110 (FIG. 9) may be attached to surface 230 using any effective technique such as conventional adhesive. Alternatively, inner shell 110 may be integral with container 200. Upper and lower rims 210 and 220 prevent inner shell 110 and outer shell 120 (FIG. 9) from slipping off container 200, and maintain inner and outer shell 110 and 120 in rotatable and concentric positions relative to each other.

Figure 11:
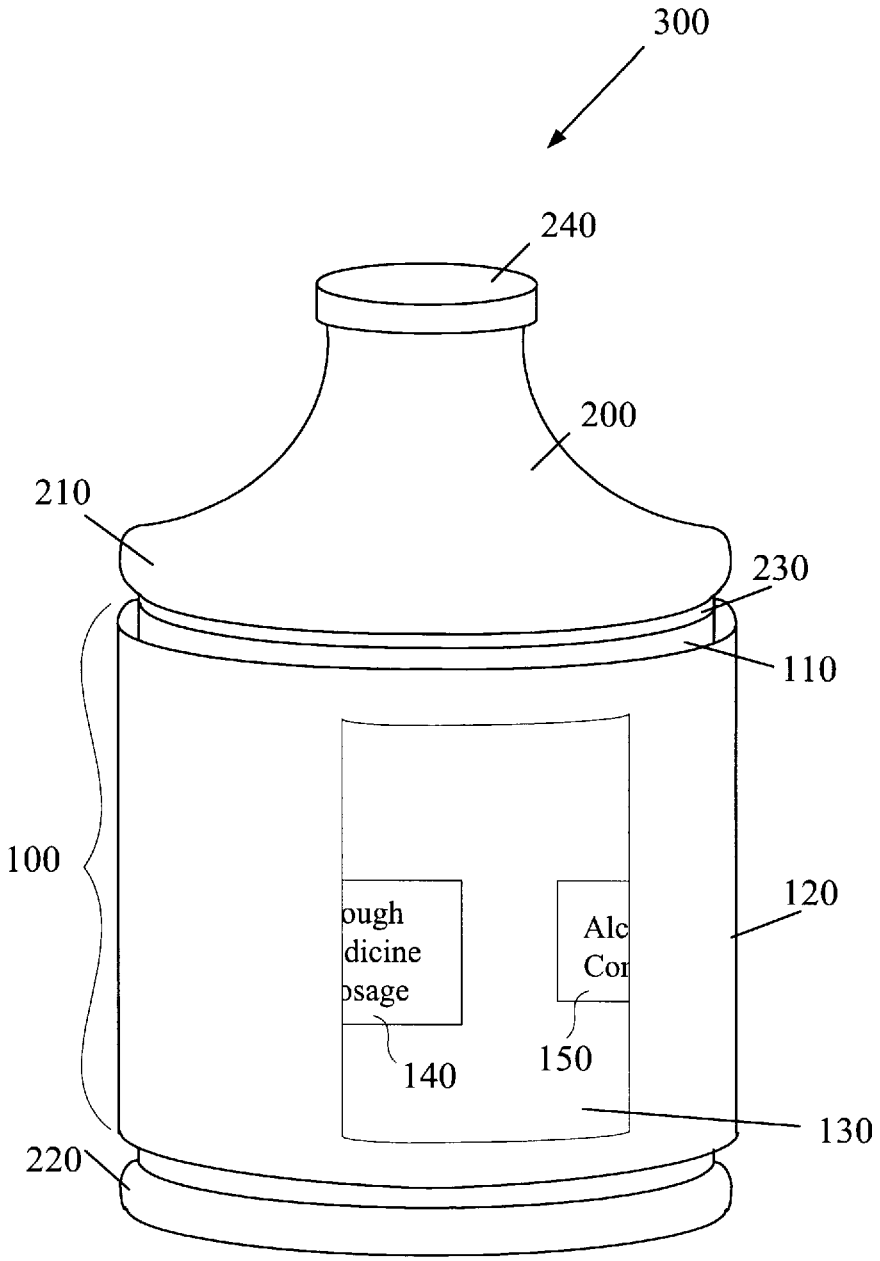
FIG. 11 is a perspective view of the presentation device of FIG. 9 located about the pharmaceutical container of FIG. 10.

Referring now to FIG. 11, a perspective view 300 of presentation device 100 supported about presentation device support surface 230 is shown. Inner shell 110 is firmly attached to surface 230. Outer shell 120 is flexibly positioned concentrically around inner shell 110. Since inner shell is attached to container 200, and outer shell 120 is flexibly and rotatably attached to inner shell 110, a user can hold container 200 while rotating outer shell 120, thereby rotating outer shell 120 around inner shell 110. Rotation of outer shell 120 enables selective viewing of inner shell 110 through region 130. This selective viewing of inner shell 110 is particularly useful in pharmaceutical container applications, since the effective viewing of the label is substantially increased. By rotating outer shell 120 to a first position with respect to inner shell 110, for instance, child dosages might appear through region 130. Moving outer shell 120 to a second position with respect to inner shell 110 might result in the display of adult dosages. In this example, a single package label can be customized for adults or children. By customizing the labeling in this way, the user is less likely to misread or be confused by the labeling than if a combined dosage chart is used. An alternative labeling embodiment might include dosage instructions in multiple languages as outer shell 120 is rotated.

Figure 12:
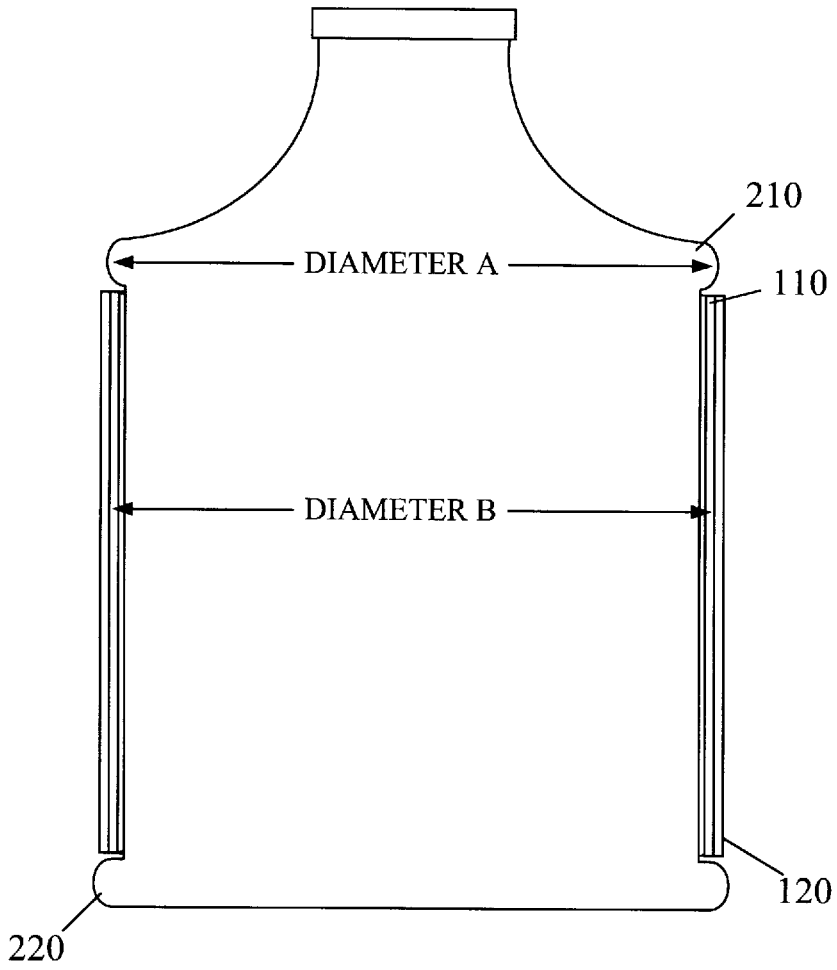
FIG. 12 is a cross-sectional view of the presentation device of FIG. 9 located about the pharmaceutical container of FIG. 10.

Referring now to FIG. 12, the dimensions of presentation device 100 and container 200 are shown. Diameter A illustrates the diameter of at least some arcuate portions of upper and lower rims 210 and 220. Diameter B illustrates the inside diameter of outer shell 120, and is smaller than diameter A. Thus, the upper edges of inner and outer shells 110 and 120 abut the underside of upper rim 210, and the lower edges of inner and outer shells 110 and 120 abut the top-side of lower rim 220, thereby preventing inner and outer shells 110 and 120 from slipping off container 200 and maintaining the rotatable connection between inner and outer shell 110 and 120. The effect of upper and lower rims 210 and 220 is to hold the outer shell 120 in an aligned position relative to the inner shell 110. This alignment enables artwork and labeling affixed to inner shell 110 to be effectively viewed through region 130 as the outer shell 120 is rotated. Although the rim regions 210 and 220 are shown in FIG. 12 to abut outer shell 120 in an almost perpendicular fashion, the curvature of rims 210 and 220 can be designed in a wide range of shapes to enhance ornamental appeal. The presence of rims 210 and 220, even if gently arcuate in shape, will tend to act as an auto-centering mechanism to maintain alignment between region 130 and inner shell 110.

Figure 13:
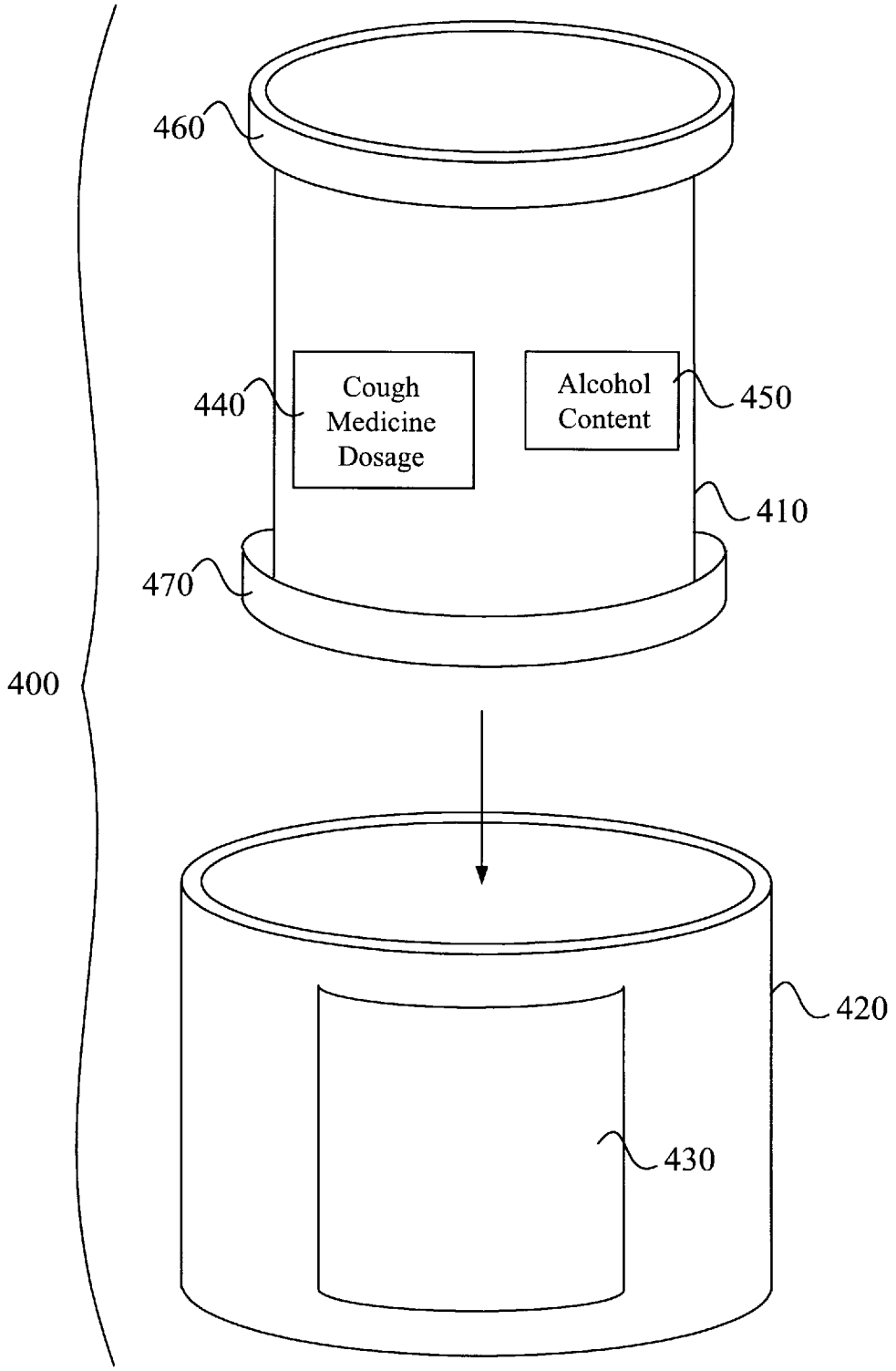
FIG. 13 is an exploded perspective view of a fourth double-walled rotatable presentation device.

Referring now to FIG. 13, an exploded perspective view of a fourth double-walled rotatable presentation device 400 is shown. Rotatable device 400 includes an inner shell 410 and an outer shell 420. Inner shell 410 can be either transparent or opaque, and is dimensioned to fit concentrically and rotatably within outer shell 420. Rotatable device 400 may be formed of any suitable material, including a flexible material such as polypropylene, acrylic resin or paper.

The outer surface of inner shell 410 supports background messages, such as cough medicine dosage message 440 and alcohol content message 450. Either surface of outer shell 420 may support a foreground message (not shown) as long as the foreground message is visible from the outer surface of outer shell 420. The foreground and background messages may be attached using any effective technique, including a conventional silk-screening process. Outer shell 420 preferably has a transparent region 430, so that a section of the background messages located on inner shell 410 can be viewed through region 430. Alternatively, outer shell 410 can be totally transparent.

In the FIG. 13 embodiment, inner shell 410 has an upper rim 460 attached to and protruding from the upper end of its outer surface, and also has a lower rim 470 attached to and protruding from the opposing lower end of its outer surface. Upper rim 460 and lower rim 470 operate together to capture and maintain outer shell 420 in a position concentrically and rotatably surrounding inner shell 410.

Figure 14:
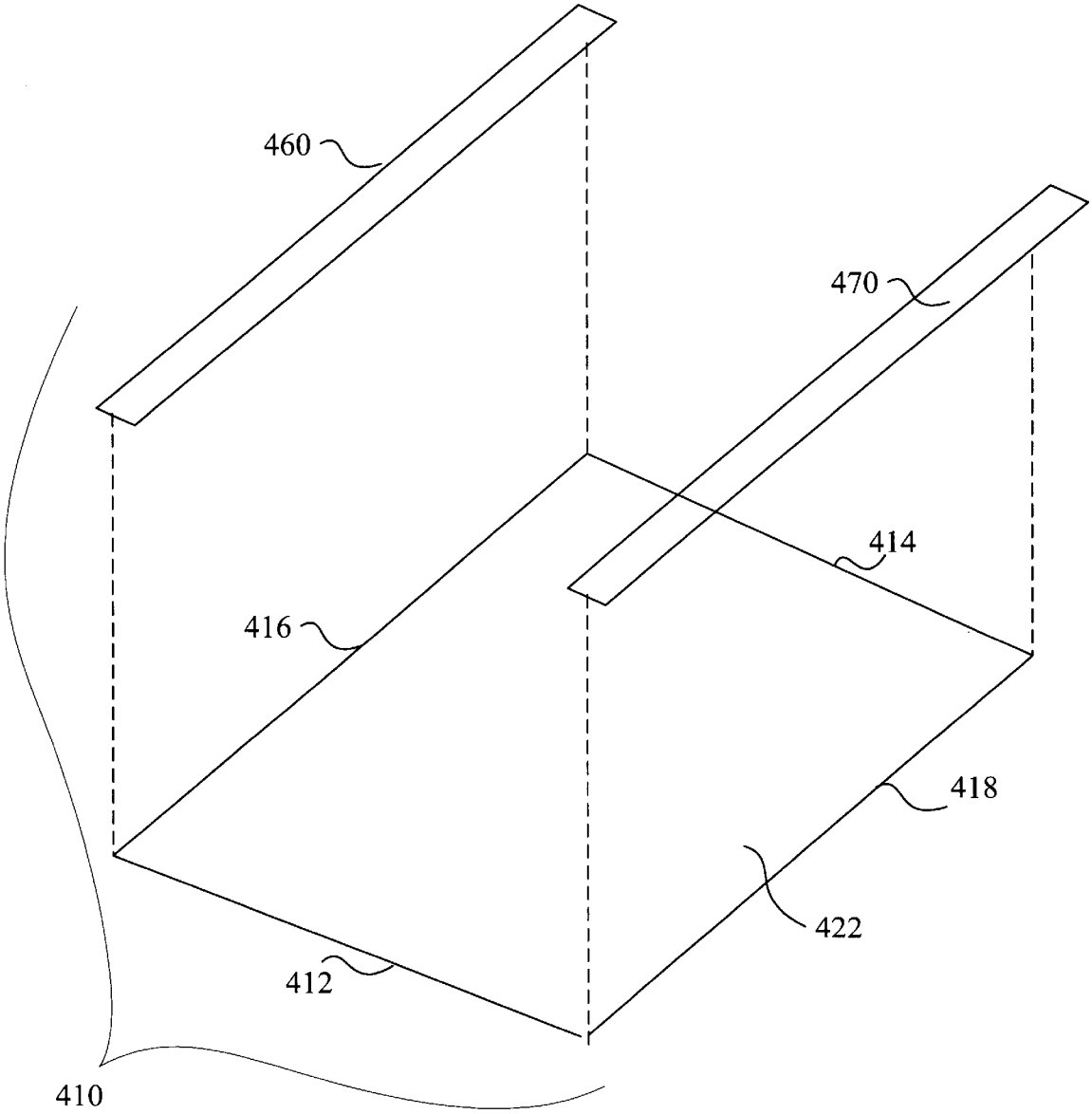
FIG. 14 is an exploded perspective view showing a planar projection of the FIG. 13 inner shell.

Referring now to FIG. 14, an exploded perspective planar projection view of the FIG. 13 inner shell 410 is shown to illustrate a possible method of manufacture, however rotatable device 400 may readily be constructed using a variety of other manufacturing techniques. In this embodiment of the invention, the upper rim 460 is attached to inner shell 410 at the top edge of its outer surface 422. Lower rim 470 is attached to inner shell 410 at the opposing bottom edge 418 of its outer surface 422. During the manufacture of rotatable device 400, upper rim 460 and lower rim 470 may be connected to the outer surface 422 of inner shell 410 using various techniques such as lamination, gluing, or may alternately be constructed integrally with inner shell 410.

After upper rim 460 and lower rim 470 are in place, inner shell 410 may be formed into a cylindrical shape by connecting its left edge 412 to its right edge 414. The cylindrical inner shell 410 thus includes upper rim 460 and lower rim 470 which protrude from parallel locations on the respective top and bottom edges 416,418 of its outer surface 422. Upper rim 460 and lower rim 470 are further sized and positioned to capture and maintain outer shell 420 in a position concentrically and rotatably surrounding inner shell 410.

Figure 15:
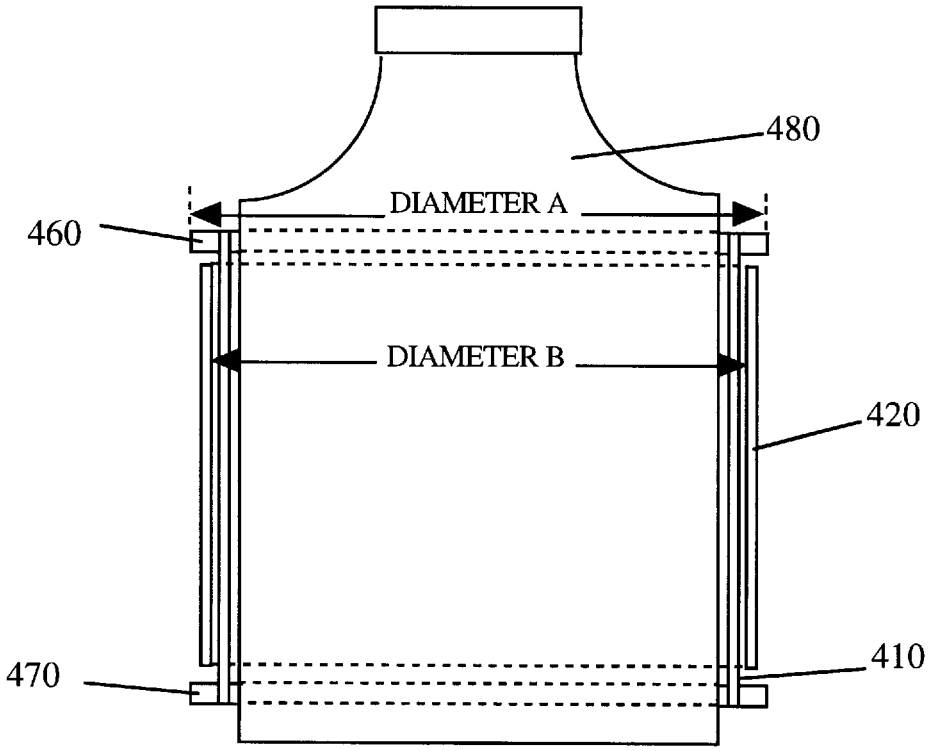
FIG. 15 is a cross-sectional view of the FIG. 13 presentation device located around a model container.

Referring now to FIG. 15, a cross-sectional view of the FIG. 13 presentation device 400 is shown located around a model container 480. Diameter A illustrates the diameter of at least some arcuate portions of upper and lower rims 460 and 470. Diameter B illustrates the inside diameter of outer shell 420, and is smaller than diameter A. Thus, the upper edge of outer shell 420 abuts the underside of upper rim 460, and the lower edge of outer shell 420 abuts the top side of lower rim 420, thereby preventing outer shell 420 from slipping off inner shell 410 and maintaining the rotatable connection between inner and outer shell 410 and 420.

The effect of upper and lower rims 460 and 470 is to hold the outer shell 420 in an aligned position relative to the inner shell 410. This alignment enables artwork and labeling affixed to inner shell 410 to be effectively viewed through transparent region 430 as the outer shell 420 is rotated. Although the rim regions 460 and 470 are shown in FIG. 15 to abut outer shell 420 in an almost perpendicular fashion, the curvature of rims 460 and 470 can be designed in a wide range of shapes to enhance ornamental appeal. The presence of rims 460 and 470, even if gently arcuate in shape, will tend to act as an auto-centering mechanism to maintain alignment between region 430 and inner shell 410.

Inner shell 410 may then be fastened to a container 480 to allow visual interaction between messages displayed on inner shell 410 and outer shell 420. In the embodiment of FIGS. 13≧15, container 480 may thus have a surface manufactured without special ridges or rims to maintain outer shell 420 in a position concentric and rotatable with respect to inner shell 410.

Figure 16A:
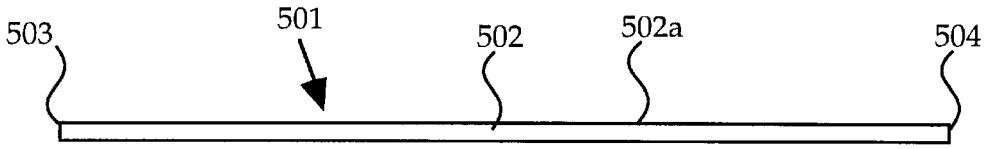
FIG. 16A is a side elevational view of an alternate embodiment of the inner shell in planar form before being disposed on a container and having a pair of opposed ends and an inner shell surface.
Figure 16B:
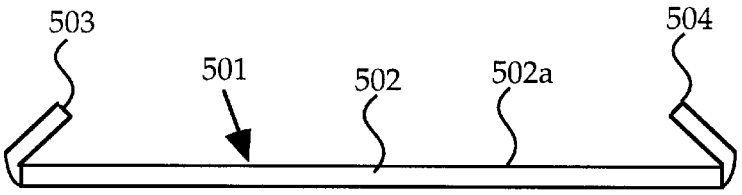
FIG. 16B is a side elevational view of the embodiment of the inner shell of FIG. 16A with opposed end portions thereof in the process of being folded towards the inner shell surface.
Figure 16C:
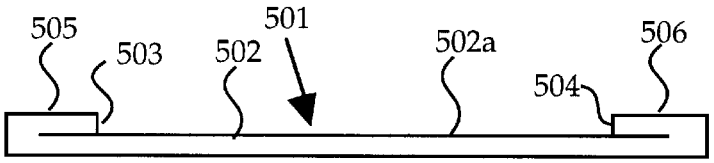
FIG. 16C is a side elevational view of the embodiment of the inner shell of FIG. 16A after the opposed end portions have been superimposed on the inner shell surface to define a pair of opposed rim members.
Figure 16D:
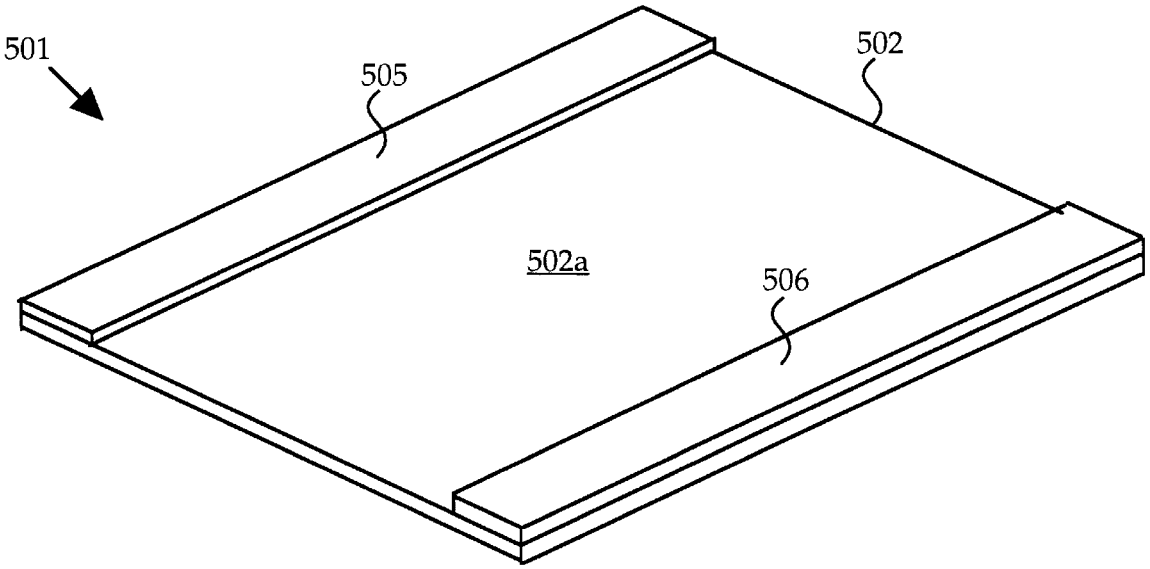
FIG. 16D is a perspective view of the inner shell of FIG. 16C.

Referring in detail to FIGS. 16A–36 for another preferred embodiment of the present invention, there is seen in FIGS. 16A, B and C side elevational views of an inner shell 501. Inner shell 501 preferably performs the same functions as the inner shell 410 shown in FIG. 13 and may be formed from any of the suitable material previously indicated. FIG. 16A is a side elevational view of an unfolded inner shell material 502 shown "edge-on"; that is, shown with opposed edges identified as upper portion 503 and lower potion 504. The inner shell material 502 has a surface 502*a*. FIG. 16B is a side elevational view of the inner shell material 502 having the upper portion 503 in the process of being folded towards the center of inner shell material 502 and also having the lower portion 504 in the process of being folded towards the center of inner shell material 502. FIG. 16C is a side elevational view of inner shell 501 after the folding has been completed, where the upper portion 503 has been superimposed over the surface 502*a* to form an upper rim 505 and where the lower portion 504 has been superimposed over the surface 502*a* to form a lower rim 506. FIG. 16D is a perspective view of the inner shell 501 after the upper rim 505 and lower rim 506 have been created by folding, as described above. Thus, for the embodiment of the inventions illustrated in FIGS. 16A–16D, the upper rim 505 and the lower rim 506 are formed respectively by the upper portion 503 and the lower portion 504 being superimposed over or on at least a portion of the surface 502*a*. After the folding process has been completed, the inner shell 501 is ready to be secured to a container in a manner described hereinafter.

Figure 17A:
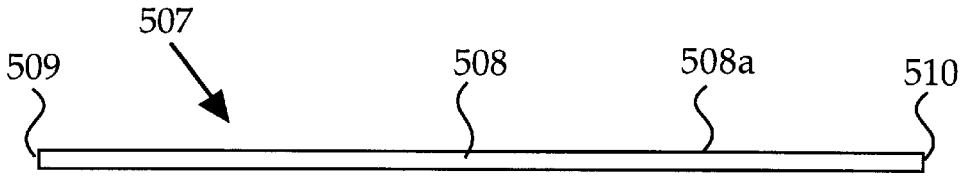
FIG. 17A is a side elevational view of another embodiment of the inner shell in planar form before being disposed on a container and having a pair of opposed ends and an inner shell surface.
Figure 17B:
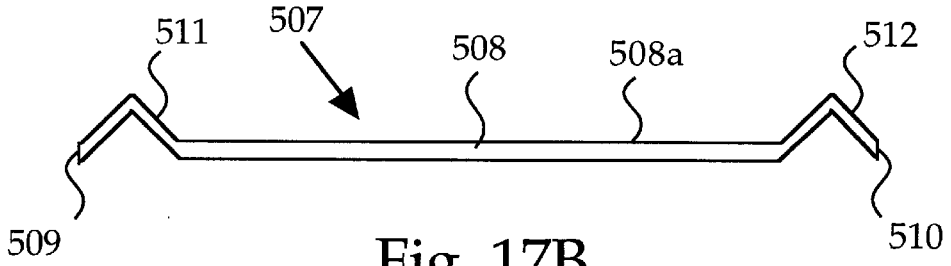
FIG. 17B is a side elevational view of the embodiment of the inner shell of FIG. 17A with a pair of askewed or deformed opposed ends which were formed by embossing to produce a pair of opposed rim members.
Figure 17C:
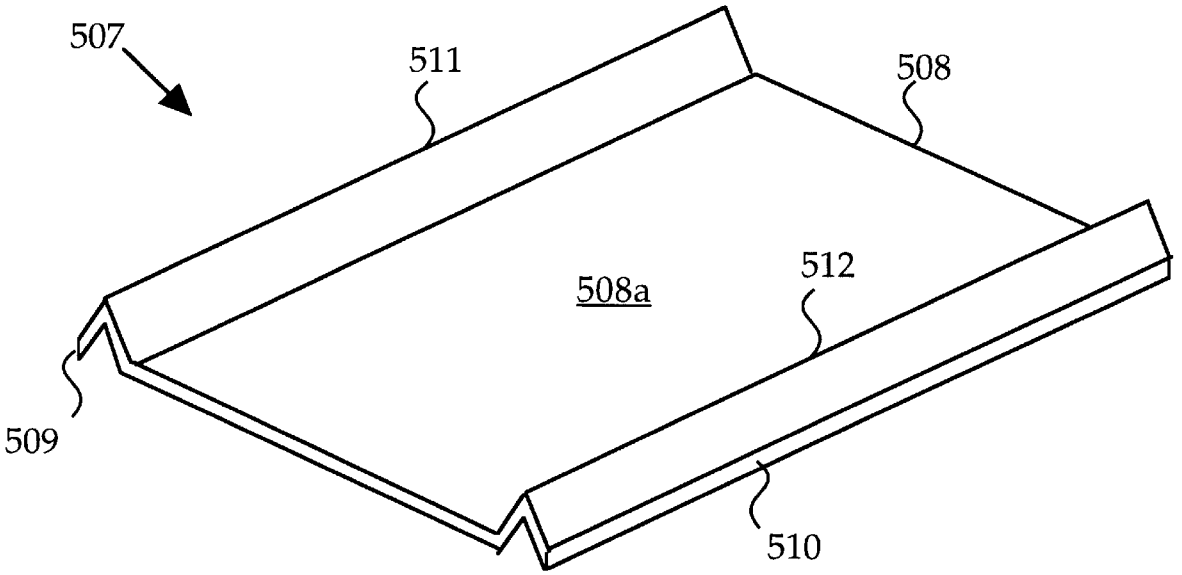
FIG. 17C is a perspective view of the inner shell of FIG. 17B.

FIGS. 17A and B are side elevational views of an inner shell 507. The inner shell 507 of FIGS. 17A, 17B and 17C preferably performs the same functions as inner shell 410 shown in FIG. 13 and may be formed from any of the previously indicated suitable material. FIG. 17A is a side elevational view of an unembossed inner shell material 508 shown "edge-on" including an upper portion 509 and a lower portion 510. The inner shell material 508 has a surface 508*a*. FIG. 17B is a side elevational view of inner shell material 508 in which upper portion 509 has been embossed to produce an upper rim 511, and in which lower portion 510 has been embossed to produce a lower rim 512. Embossing is a conventional technique for raising the surface of a material through the use of an embosser. The term "embossing" as used herein would include to mean any method or any apparatus that would askew or deform the structure of a material, such as the material for forming one or more of the shell members. FIG. 17C is a perspective view of the inner shell 507 depicted in FIG. 17B; more specifically, FIG. 17C is a perspective view of the inner shell material 508 after the upper rim 511 and the lower rim 512 have been created by the embossing process. Thus, with respect to the embodiment of the invention depicted on FIGS. 17A–17C, embossing interrupts surface 508*a* to askew or deform the upper portion 509 and the lower portion 510 and respectively produce the inner rim 511 and the lower rim 512. After the embossing method is completed, the inner shell 507 may be secured (i.e. glued) to and around a cylindrical side of any container.

Figure 18A:
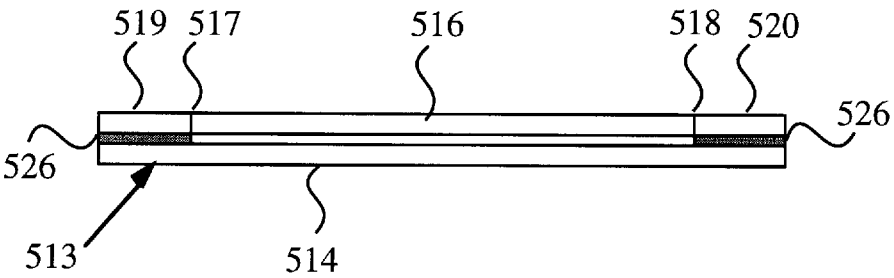
FIG. 18A is a side elevational view of yet another embodiment of the inner shell with an attached outer shell having two sets of structural perforations.
Figure 18B:
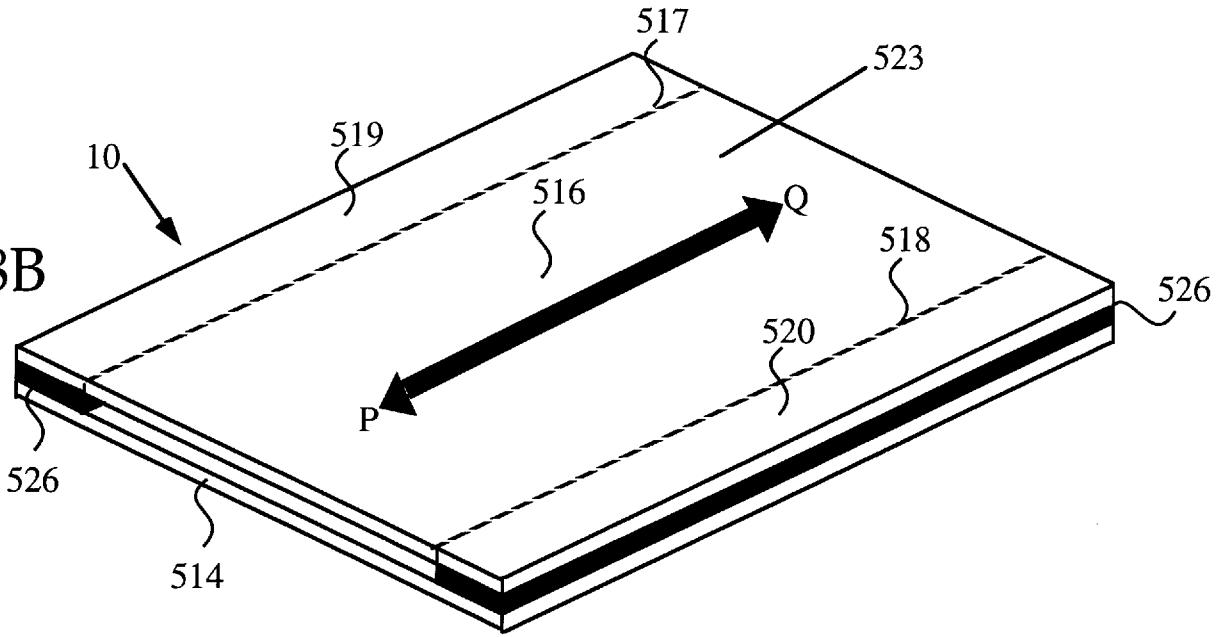
FIG. 18B is a perspective view of the embodiment of the invention in FIG. 18A.
Figure 18C:
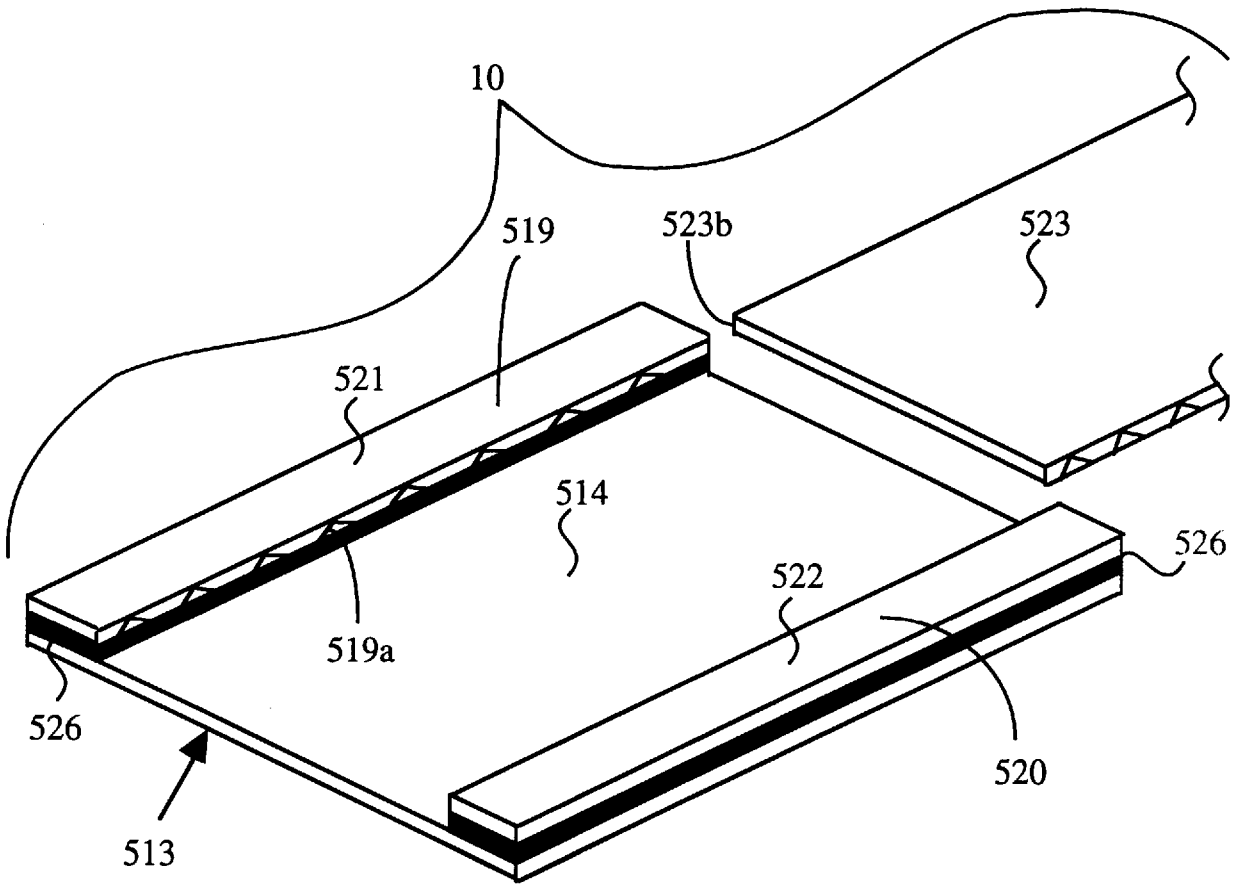
FIG. 18C is a perspective view of the inner shell with a portion of the outer shell removed therefrom after the two sets of structural perforations have been broken and torn.
Figure 18D:
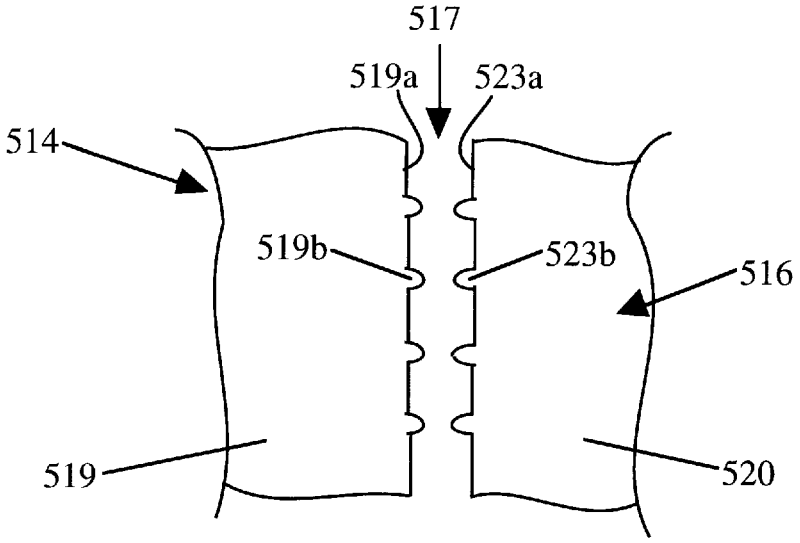
FIG. 18D is a planar view of the notches of the corrugated edge of the upper portion and of the notches of the corrugated edge of the outer shell body.
Figure 18E:
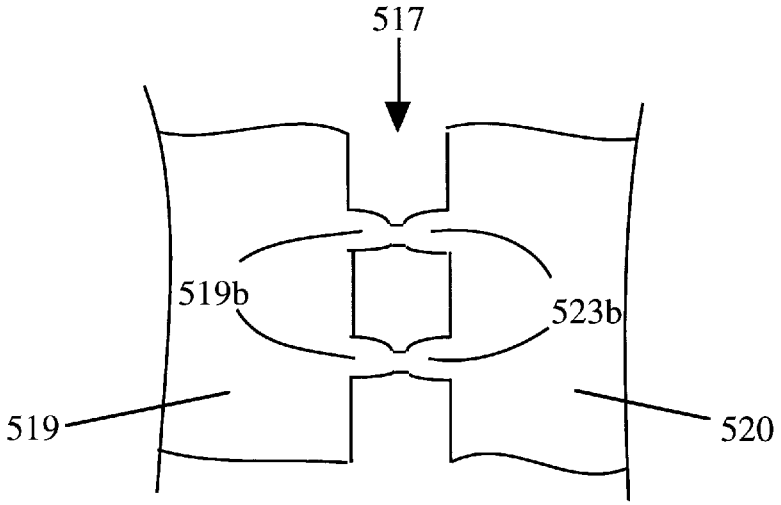
FIG. 18E is a planar view of the notches from both corrugated edges of FIG. 18D integrally interconnected to produce a set of structural perforations.

Referring in detail now to FIGS. 18A–18E there is seen another embodiment of the present invention wherein an inner shell 513 has an outer shell material 516 attached thereto. The outer shell material 516 has an outer shell body 523 and an upper portion 519 and a lower portion 520 respectively separated from the outer shell body 523 by a first set of perforations 517 and a second set of perforations 518. The inner shell 513 preferably performs the same functions as inner shell 410 shown in FIG. 13 and may be formed from any of the previously identified suitable materials. The inner shell 513 is comprised of an inner shell material 514 that is connected to the outer shell material 516 by an adhesive substance 526. More specifically and as best shown in FIG. 18B, the inner shell material 514 is secured to the upper portion 519 and to the lower portion 520 of the outer shell material 516 with the adhesive substance 526. The upper portion 519 has a corrugated edge 519*a* (see FIG. 18D) with notches 519*b*; and the outer shell body 523 (see FIG. 18D again) has a corrugated edge 523*a* with notches 523*b*. As best shown in FIG. 18E, notches 519*b* and notches 523*b* integrally interconnect to produce the set of structural perforations 517. It is to be understood that whenever any set of structural perforations are mentioned hereinafter, such set of structural perforations inherently includes notches of one corrugated edge connecting integrally with notches of another corrugated edge.

FIG. 18B is a perspective view of the alternate embodiment of FIG. 18A. Forces (rotational forces) along a line P-Q on the outer shell material 516 cause the first and second set of perforations 517,518 to break, freeing the outer shell body 523 of the outer shell material 516 from the upper portion 519 and from the lower portion 520, both of which remain secured to the inner shell 513, more specifically to the inner shell material 514. The freed outer shell body 523 is now available to be rotated around the inner shell 513 as desired. FIG. 18C is a perspective view of the inner shell 513 after the perforations 517 and 518 have been broken. After the perforations 517 and 518 are broken, the upper portion 519 becomes an upper rim 521 and the lower portion 520 becomes a lower rim 522, thus creating the inner shell 513 which now may be secured to cylindrical sides of any container via any suitable adhesive substance (i.e. adhesive substance) disposed on the back of the inner shell 513.

The adhesive substance 526 for the present invention may be any inorganic or organic, natural or synthetic substance that is capable of bonding together any of the structural elements or members of the present invention by surface attachment. A suitable adhesive substance 526 is glue or any other similar suspension of various proteinaceous materials in water, well known to those possessing the ordinary skill in the art. Additional suitable adhesive substances would include soluble silicates (water glass); calcium oxide-silica; silica-boric acid; fish glue; organic vegetable glues including cellulosics, rubber latex and rubber-solvent (pressure-sensitive), mucilages; polysulfide sealants; silicone polymers and cements; and thermosetting epoxy, phenolformaldehyde, polyvinyl butyral and cyanoacrylates.

Figure 19A:
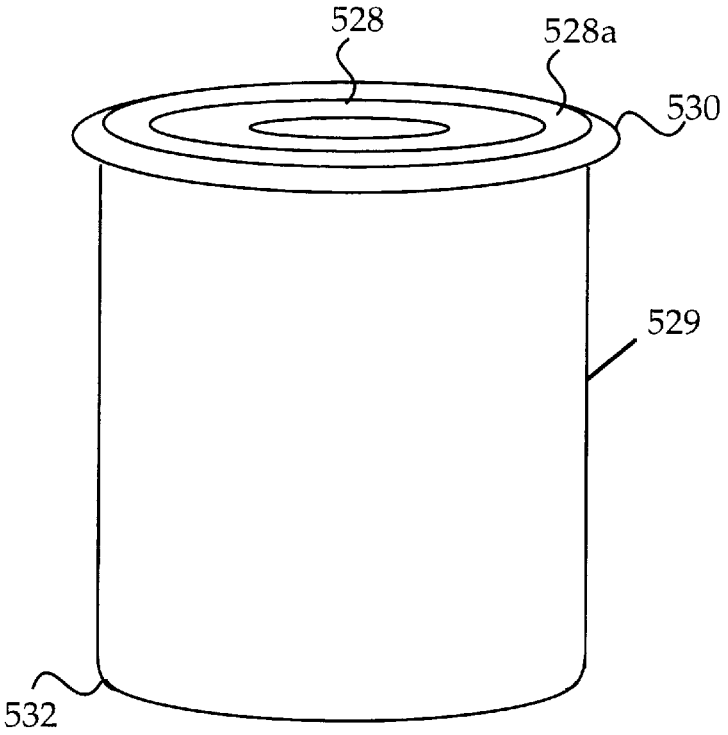
FIG. 19A is a perspective view of a container with a container rim.
Figure 19B:
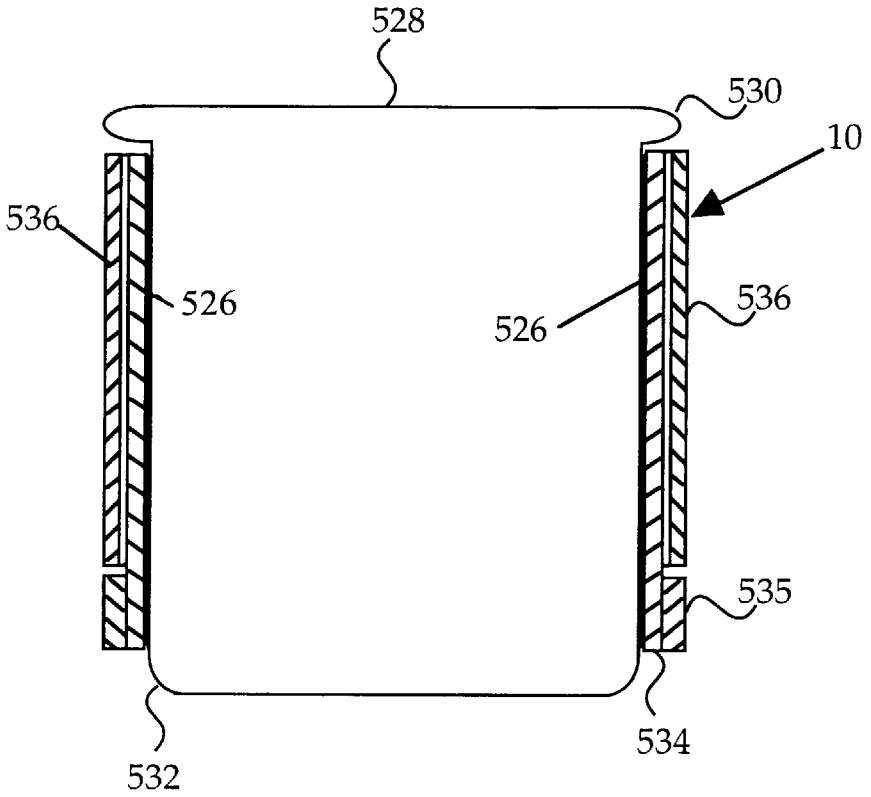
FIG. 19B is a sectional view of a double-walled rotatable presentation device (i.e. an outer shell rotatably disposed around an inner shell) attached to the container of FIG. 19A.

FIG. 19A is a perspective view of a container 528. The container 528 is shown in perspective and includes an upper rim 530 and a curved bottom 532. Preferably, the container 528 is formed of two pieces, a one piece vacuum molded lower portion 529 which forms the bottom and sides of the container 528 and a one piece top portion 528*a*. The top portion 528*a* is coupled to the lower portion 529 by the upper rim 530. Since the container 528 has a curved bottom 532, the container 528 may be easily stacked on top of another similarly manufactured container. FIG. 19B is a sectional view of an inner shell 534 encircling and being connected and coupled to the container 528 by the adhesive substance 526. The inner shell 534 has a lower rim 535 attached thereto. The upper rim 530 and the lower rim 535 perform the same functions as the upper rim 460 and the lower rim 470 shown in FIG. 13. However, a key difference between the embodiment shown in FIG. 13 and the embodiment shown in FIG. 19B, is that in FIG. 13 the upper rim 460 and the lower rim 470 are attached to the inner shell 410, whereas in FIG. 19B, only the lower rim 535 is attached to the inner shell 534, while the upper rim 530 is part of the container 528. An outer shell 536 is rotatably disposed around the inner shell 534 while being bounded by the upper rim 530 and the lower rim 535 in the same manner as the upper rim 460 and lower rim 470 in FIG. 13 bound its outer shell 420. The outer shell 536 is capable of being rotated 360 degrees about the inner shell 534 and the container 528. Alternatively, a container (not shown) may have a lower rim and no upper rim. In this alternate embodiment, an inner shell would be formed with an upper rim so that an outer shell would be bounded by the upper rim of the inner shell and the lower rim of the container.

Figure 20:
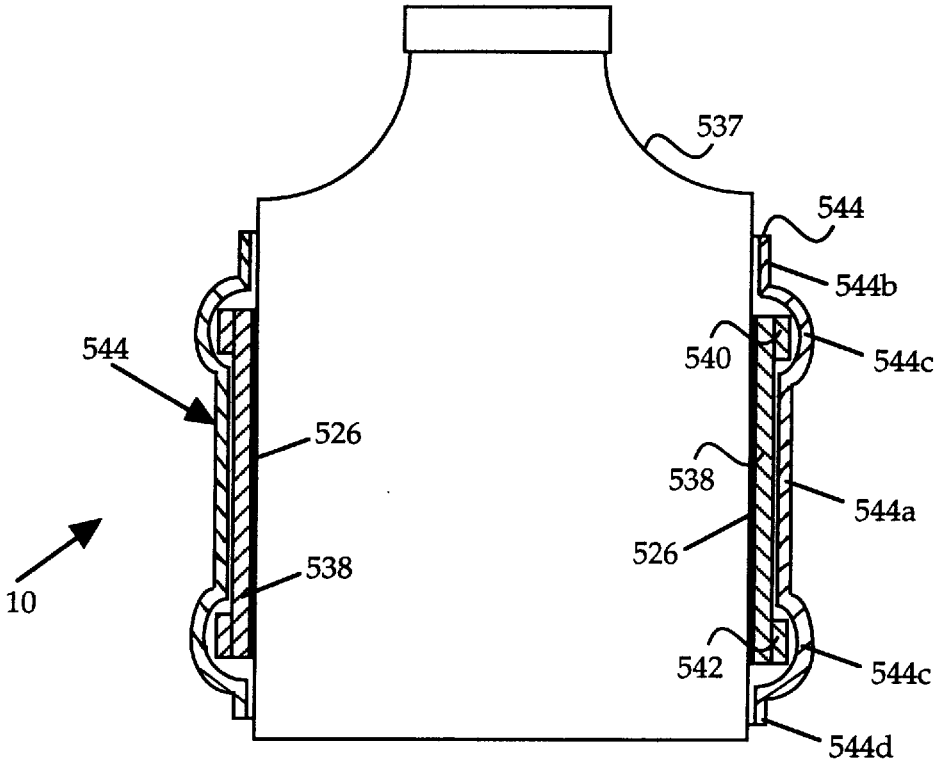
FIG. 20 is a sectional view of another double-walled rotatable presentation device (i.e. an outer shell rotatably disposed around an inner shell) attached to a container.

There is seen in FIG. 20 a sectional view illustrating an inner shell 538 having an upper rim 540 and a lower rim 542 and encircling the container 537. The inner shell 538 is securely coupled to the container 537 by the adhesive substance 526 so that it can not move. An outer shell 544, preferably made of a shrink-wrap material, conforms to the surfaces created by the upper rim 540, the lower rim 542, the inner shell 538 and the container 537. A suitable shrink-wrap material include has been found to be a PVC film sold under the trade name Ninja film by Uniflex Corporation of Anaheim Hills, Calif.

As shown in FIG. 20, the outer shell 544 has a pair of structural recesses 544*c*—544*c* wherein the upper and lower rims 540 and 542 lodge to rotatably support the outer shell 544 as the same is rotated around the inner shell 538. The outer shell 544 has planar surfaces 544*a* and 544*b* which are off-set (i.e. not collimated) with respect to each other and are separated by one of the structural recesses 544*c*. The outer shell 544 also has a planar surface 544*d* which is off set from the planar surface 544*a* by the other structural recess 544*c*. The outer shell 544 rotates about the inner shell 538 and the container 537. In an alternate embodiment to the embodiment depicted in FIG. 20, only one rim is located along the inner shell 538 and the outer shell 544 conforms to surface features created by the one rim, the inner shell 538 and the container 537. Thus for this alternate embodiment, the outer shell 544 would be possessed with only one structural recess 544*c*. In a second alternate embodiment three or more rims may be attached to the inner shell 538, to which the outer shell 544 would conform with by possessing three or more structural recess 544*c*.

Figure 21:
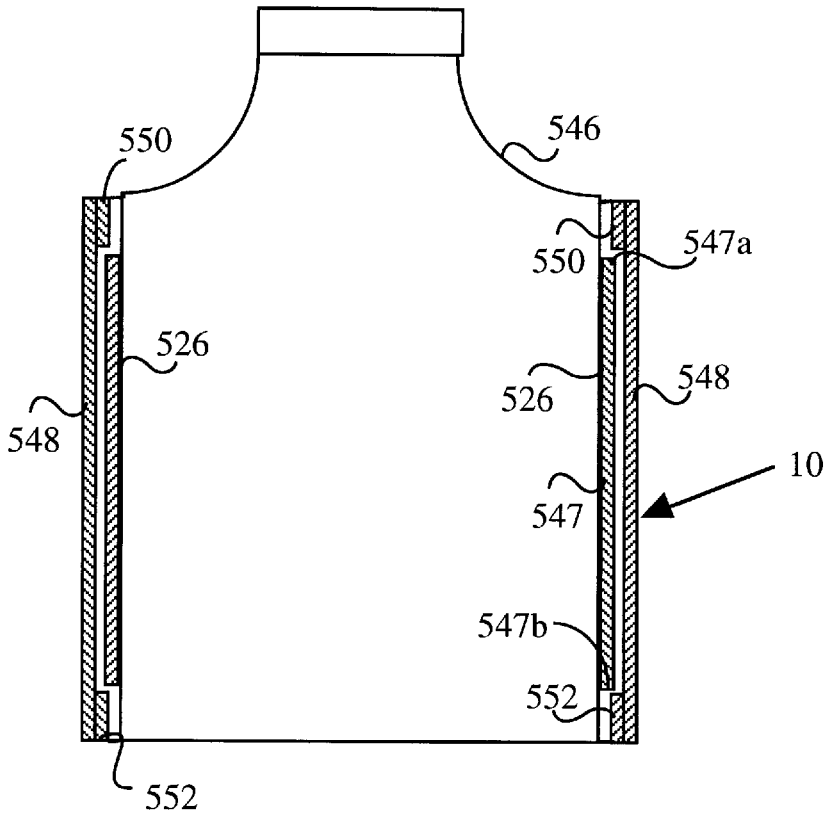
FIG. 21 is a sectional view of yet another double-walled rotatable presentation device (i.e. an outer shell rotatably disposed around an inner shell) attached to a container.

FIG. 21 is a sectional view of yet another embodiment of the present invention wherein an inner shell 547 is shown as encircling and being securely attached to the container 546 by the adhesive substance 526. The inner shell 547 has opposed edges 547*a* and 547*b*. An outer shell 548 includes an upper rim 550 and a lower rim 552. The upper rim 550 and the lower rim 552 can be formed with and/or on the outer shell 548 by gluing, folding, embossing or perforating, as described above. As the outer shell 548 rotates about the inner shell 547 and the container 546, the upper rim 550 and the lower rim 552 slideably engage the opposed edges 547*a* and 547*b* of the inner shell 547. The upper rim 550 and the lower rim 552 keep the outer shell 548 longitudinally positioned about the inner shell 547 during rotation.

Figure 22:
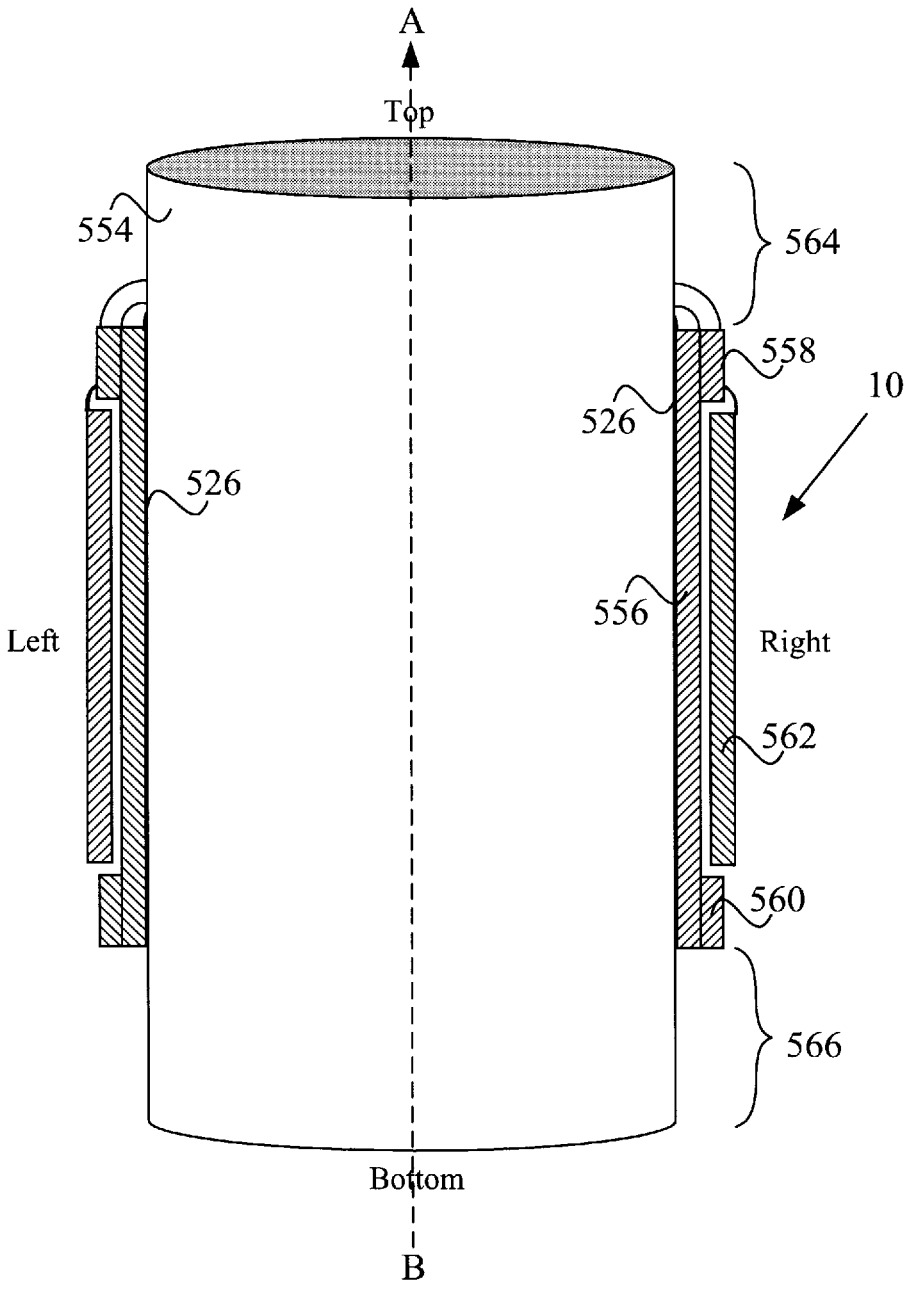
FIG. 22 is a combined perspective and sectional view of a container having an inner shell secured thereto with an outer shell rotatably supported by the inner shell and rotatably disposed around the inner shell.

FIG. 22 is a combined perspective and sectional view of a container 554 having an inner shell 556 and an outer shell 562 shown in section. The inner shell 556 is connected to the container 554 by the adhesive substance 526 and includes an upper rim 558 and a lower rim 560 which limits movement of the outer shell 562 along the A-B axis of the container 554 in the same manner as that described with reference to FIG. 13. The inner shell 556 is positioned along the A-B axis to provide a top grasping area 564 towards a top of the container 554 and a bottom grasping area 566 towards a bottom of the container 554. These grasping areas 564,566 provide a surface area on the container 554 for a user to hold the container 554 while rotating the outer shell 562 and reading a set of information printed on the inner shell 556 and/or the outer shell 562. For example, if information was printed from left-to-right (i.e. around the container's circumference) on the shells 556 and 562, a user would most likely hold the bottom grasping area 566 while rotating the outer shell 562. However, if information was printed from top-to-bottom on the shells 556 and 562, a user would most likely hold the top grasping area 564 while rotating the outer shell 562. In alternate embodiments, container 554 may contain only the top grasping area 564 or the bottom grasping area 566.

In the above discussion it has been shown how a container, an inner shell and an outer shell can each include a set of rims. In some embodiments of the present invention the inner shell included two rims and the outer shell included no rims. In other embodiments the container included one rim, the inner shell included one rim and the outer shell included no rims. And, in yet other embodiments, the inner shell included no rims and the outer shell included two rims. Those skilled in the art will thus know that the container, the inner shell and the outer shell may each include a set of rims, wherein the set of rims may include any number of rims or no rims at all.

Figure 23:
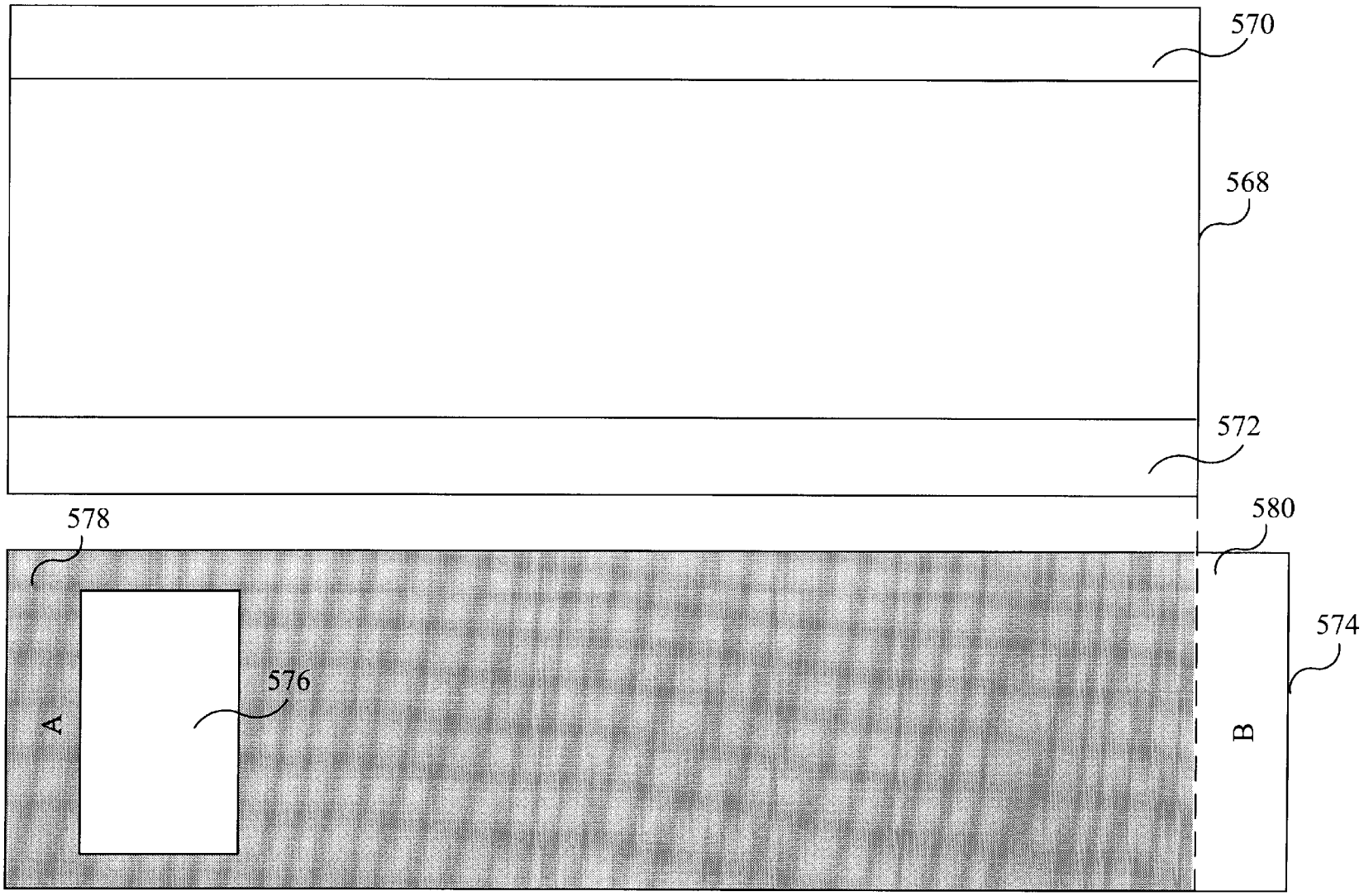
FIG. 23 is a plan view of an inner shell with a pair of opposed rim members and an outer shell flattened out and laid side-by-side.
Figure 24:
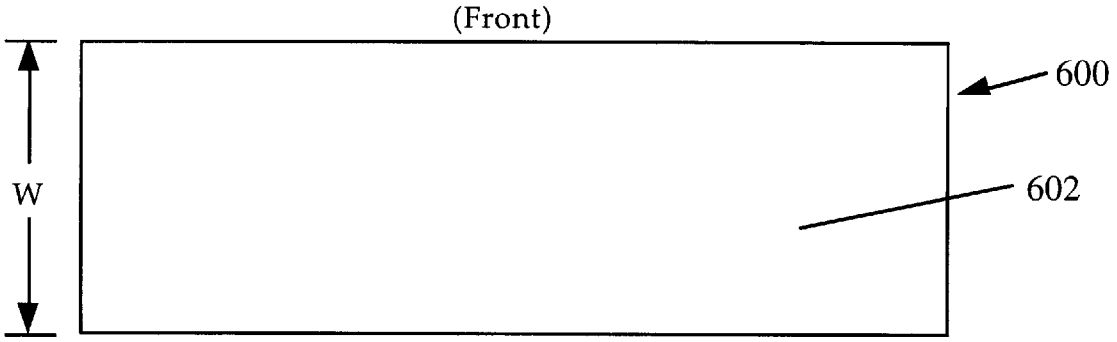
FIG. 24 is a planar view of the front of an inner shell.
Figure 25:
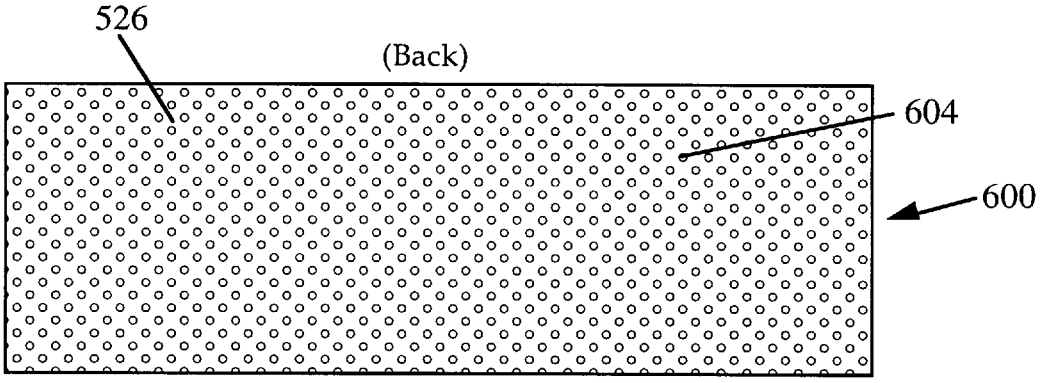
FIG. 25 is a planar view of the back of the inner shell of FIG. 24 having an adhesive substance disposed thereon for securing the inner shell to a container.

FIG. 23 is an exploded plan view of an inner shell 568 and an outer shell 574 flattened out and laid side-by-side. The outer shell 574 is longer in length than the inner shell 568 by an amount shown by a lug or tab shown as extension area B 580. The inner shell 568 includes an upper rim 570 and a lower rim 572 and the outer shell 574 includes a window 576, an area A 578 and the extension area B 580. The inner shell 568 is attachable to a container (not shown) by wrapping the inner shell 568 around the container and securely fixing the inner shell 568 to the container, such as with the adhesive substance 526. The outer shell 574 is movably positionable about the inner shell 568 between the upper and lower rims 570 and 572 by wrapping the outer shell 574 around the inner shell 568 and securely fixing area A 578 to the extension area B 580. More specifically, the lug or tab represented by the extension area B 580 would typically overlap onto the fixing area A 578 with the adhesive substance 526 affixing the lug or tab 580 to the area A578.

Figure 26:
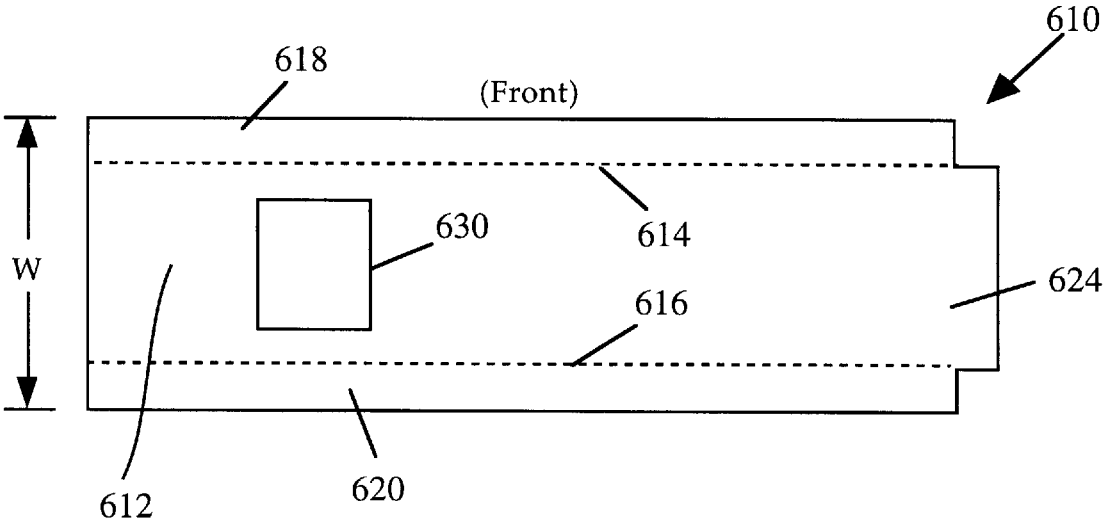
FIG. 26 is a planar view of the front of an outer shell having a window or transparent region and a lug or tab member and with two sets of structural perforations.
Figure 27:
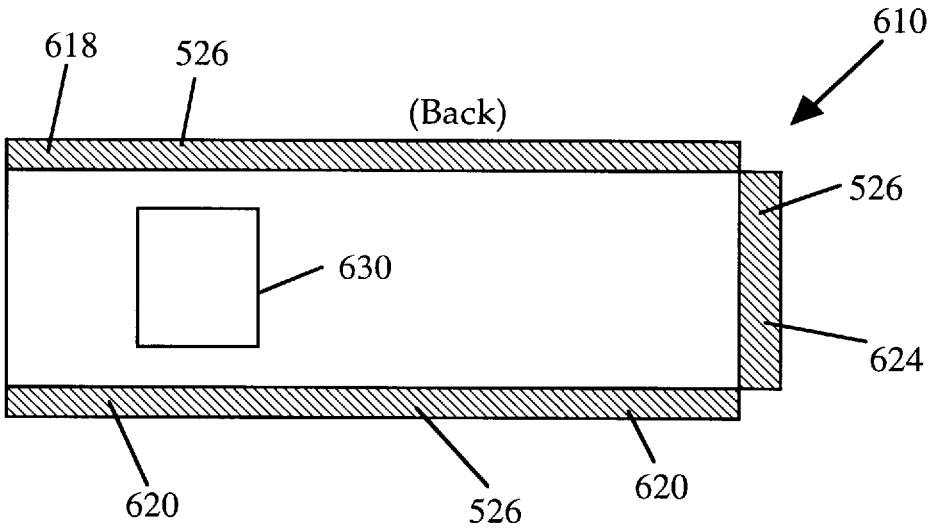
FIG. 27 is a planar view of the back of the outer shell of FIG. 26 illustrating a pair of opposed outer side portions having an adhesive substance disposed thereon for securing the pair of opposed outer side portions to the inner shell, and further illustrating the lug or tab member also having an adhesive substance disposed or layered thereon for securing the lug or tab member to the outer shell to form a generally cylindrical outer shell member that may rotate around the face of the inner shell member when the outer shell member is torn away from the pair of opposed outer side portions along the two sets of structural perforations.
Figure 28:
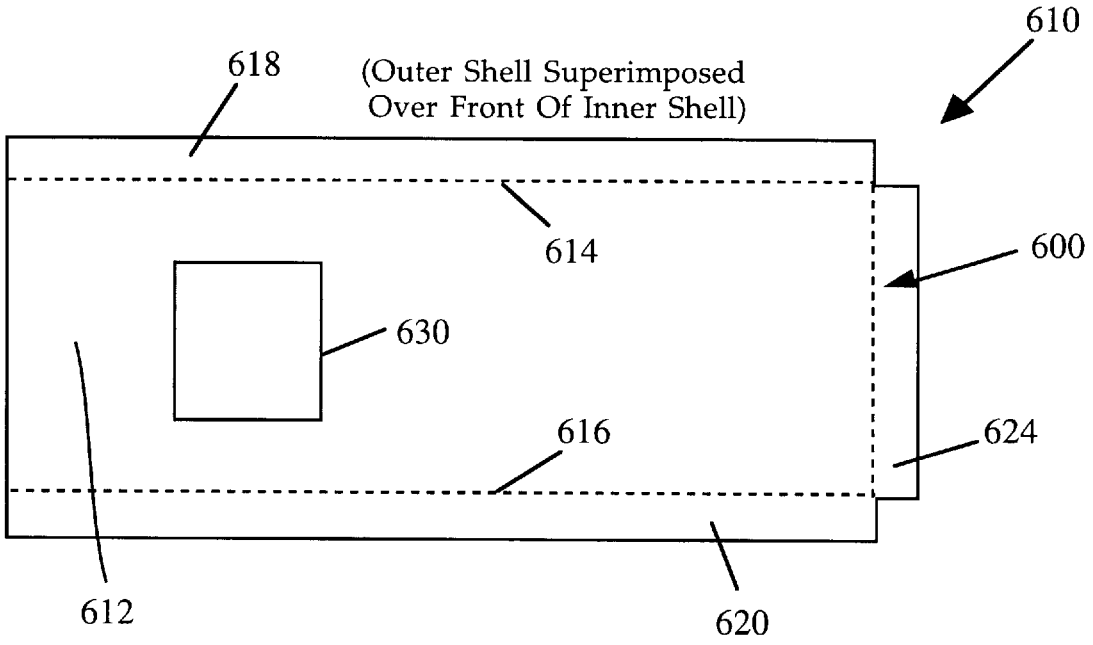
FIG. 28 is a planar view of the outer shell of FIGS. 26 and 27 superimposed over the front of the inner shell of FIG. 24 and having the pair of opposed outer side portions secured to the front of the inner shell.
Figure 29:
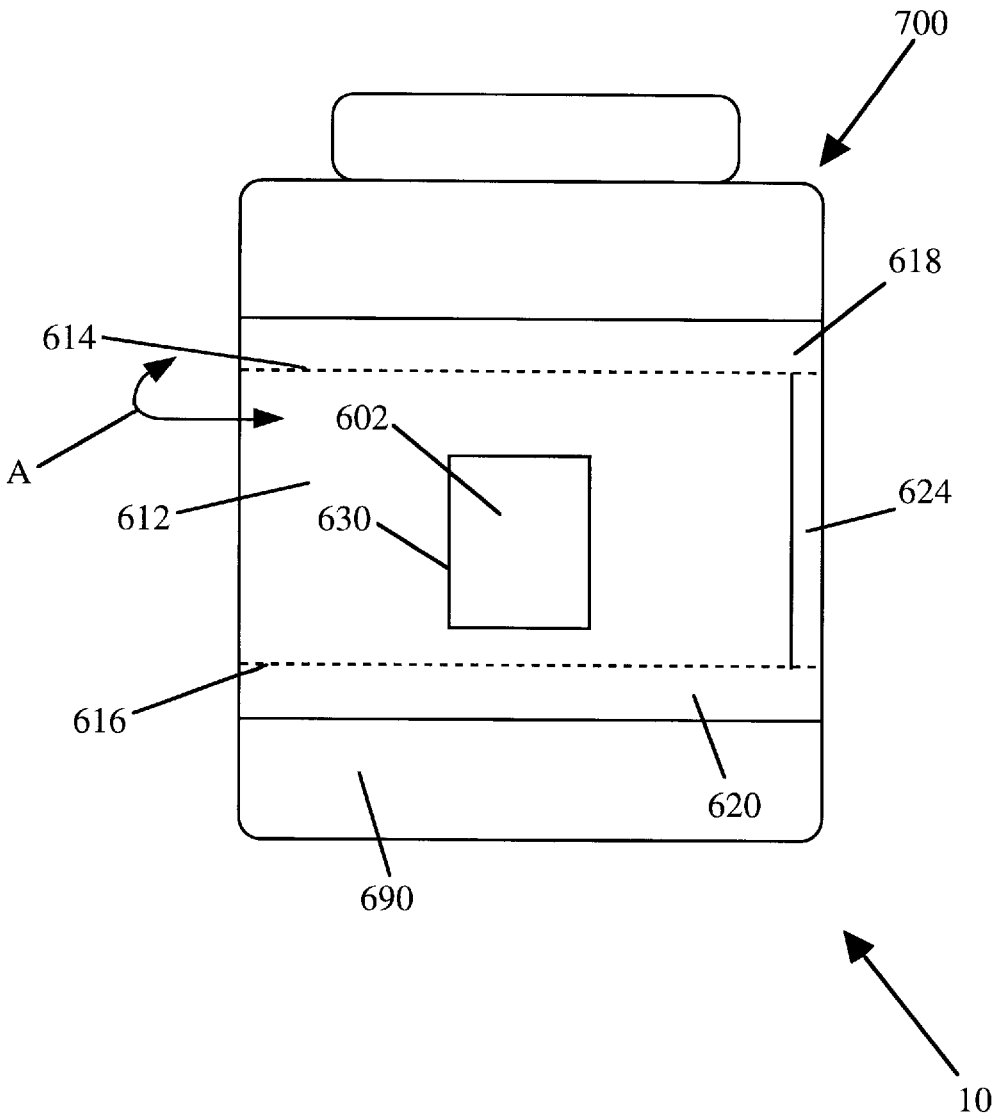
FIG. 29 is a perspective view of a container having the back of the inner shell of FIG. 28 glued, stuck or otherwise attached to the container such that the front of the outer shell of FIG. 28 encirculates the cylindrical sides of the container.

Referring now to FIGS. 24–29 there is seen an inner shell, generally illustrated as 600, having a front 602, a back 604, and the adhesive substance 526 disposed or layered on the back 604. The inner shell 600 (see FIG. 24) has a width W. An outer shell, generally illustrated as 610, is seen in FIGS. 26 and 27 as having the same width W as the inner shell 600. The outer shell 610 has an outside surface 612 between a pair of sets of perforations 614 and 616. The outer shell 610 includes a pair of opposed outer side portions 618 and 620 which are releasable when the sets of perforations 614 and 616 are torn or broken. The outer shell 610 is formed with an ear or lug 624 and includes a window or transparent region 630. As best shown in FIG. 27, the adhesive substance 526 is disposed on the back of the outer side portions 618 and 620 and the back of the ear or lug 624. The outer shell 610 is secured to the front 602 of the inner shell 600 by superimposing the outer shell 610 over the inner shell 600 (see FIG. 28) and pressing the outer side portions 618 and 620 against the front 602 of the inner shell 600 such that the adhesive substance 526 on the underside of the outer side portions 618 and 620 bind the outer side portions 618 and 620 (and inherently the entire outer shell 610 itself) to the inner shell 600. Subsequently, the combination of FIG. 28 is secured to a cylindrical side 690 of a container 700 (see FIG. 29) by encircling the cylindrical side 690 with the combination and pressing the back 604 of the inner shell 600 against the cylindrical side 690 such that the adhesive substance 526 may take its associated binding effect. Obviously, the immediate foregoing procedure may be reversed by initially securing the inner shell 600 to the cylindrical side 690 of the container 700 and subsequently securing the outer shell 610 to the front 602 of the inner shell 600 in the manner described above. As (or immediately thereafter) the combination of FIG. 28 is being secured to the cylindrical side 690 of the container 700, the ear or lug 624 overlaps onto the outside surface 612 of the outer shell 610 such that the adhesive substance 526 (see FIG. 27) on the bottom of the ear or lug 624 may bind the ear or lug 624 onto and against the outside surface 612 of the outer shell 610 as best shown in FIG. 29. As will be seen for the embodiment of the invention depicted in FIGS. 30A–34B, rotational force (and preferably some pressure) in direction of the arrow A in FIG. 29 breaks or tears along the sets of perforations 614 and 616 causing the outer side portions 618 and 620 to be released from the outer shell 610 such that the outer shell 610 may rotate freely around the inner shell 600 between the affixed outer side portions 618 and 620 which are now functioning as rim members or elements.

Figure 30A:
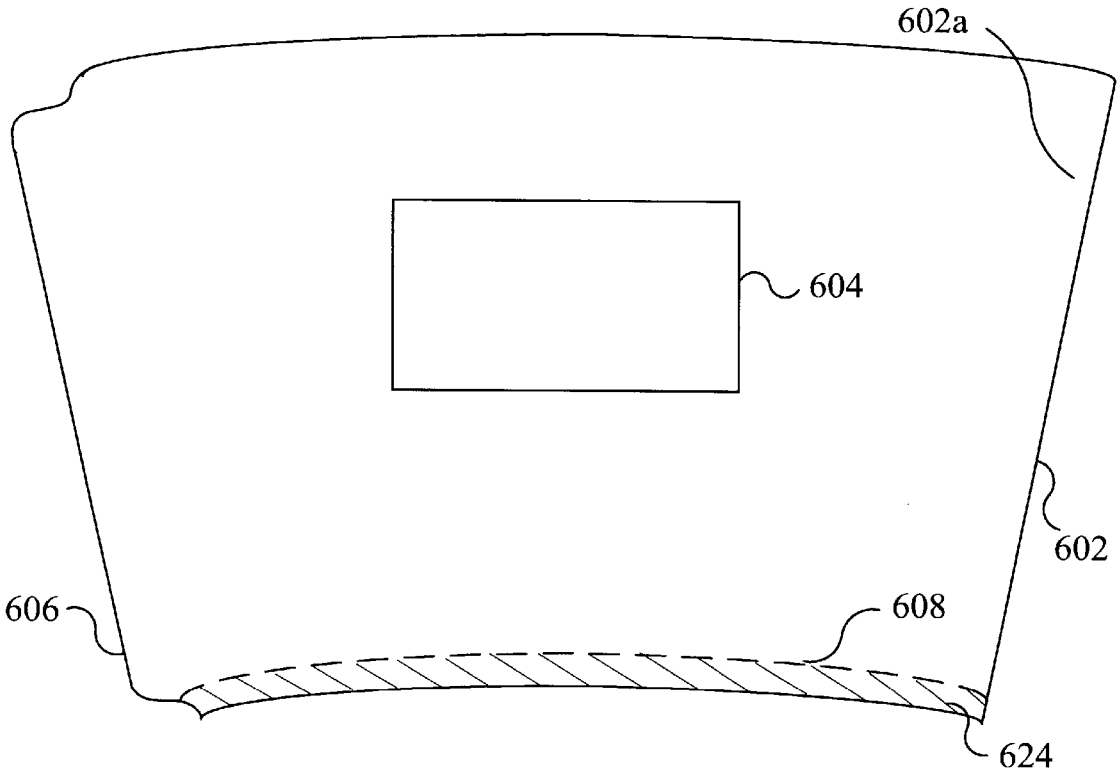
FIG. 30A is a plan view of an outside surface of a generally trapezoidal shaped outer shell.
Figure 30B:
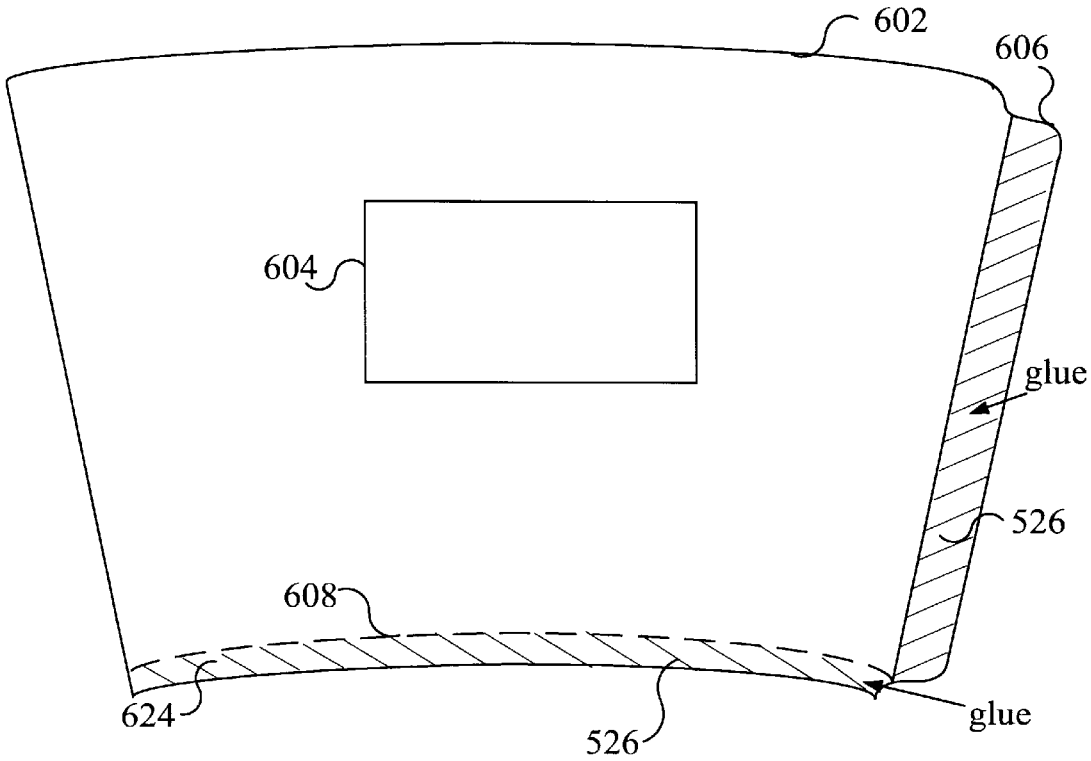
FIG. 30B is a plan view of an inside surface of the outer shell of FIG. 30A.
Figure 31A:
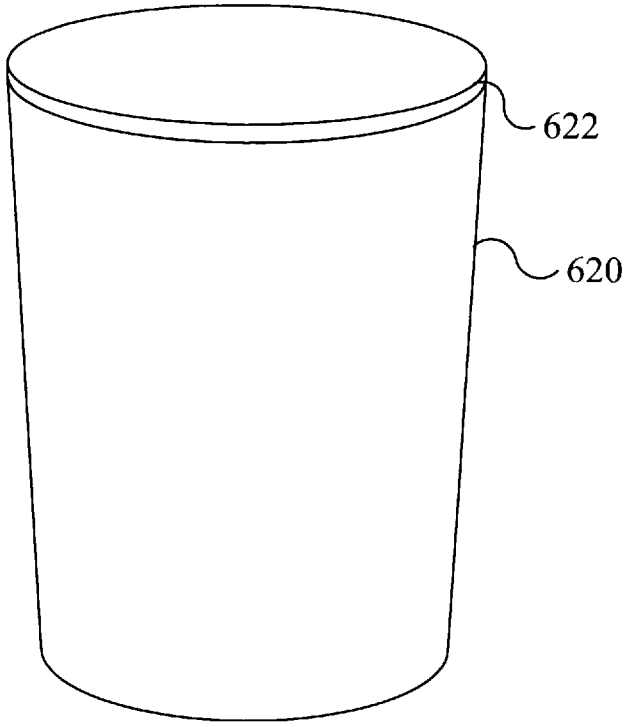
FIG. 31A is a perspective view of a container including an upper rim.
Figure 31B:
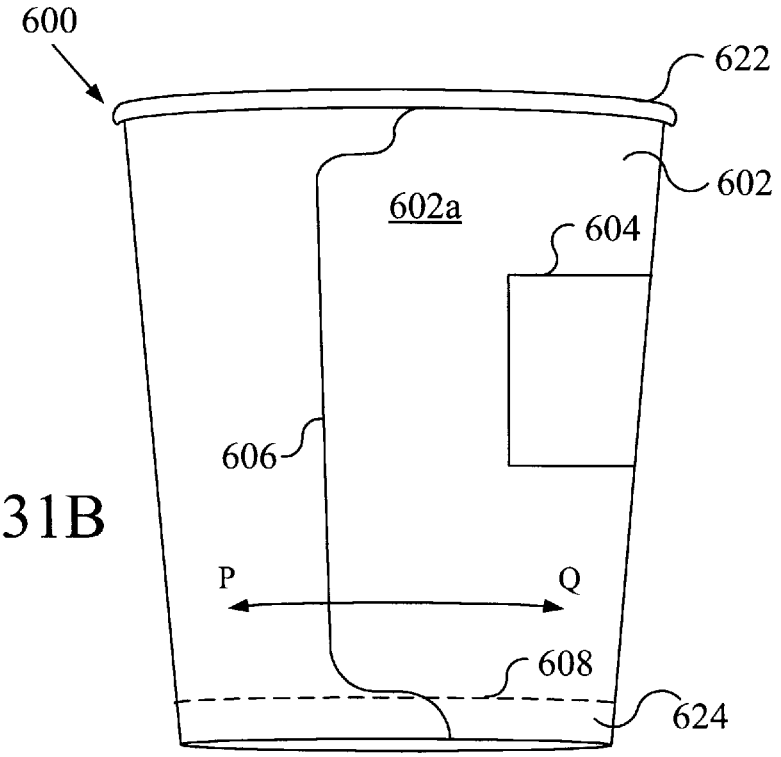
FIG. 31B is a perspective view of the container of FIG. 31A having an inner shell secured to the sides thereof and having an outer shell rotatably disposed around the inner shell.

Referring now to FIGS. 30A–31B, there is seen in FIG. 30A a plan view of an outside surface of an outer shell 602 which is generally trapezoidal in shape to conform to a downwardly tapering container. The outer shell 602 includes an outer surface 602*a*, a window 604, an extension area (or lug/tab) 606, and a set of structural perforations 608. FIG. 30B is a plan view of an inside surface of the outer shell 602. The adhesive substance 526 is applied to an area of the inside surface of the outer shell 602 below the set of perforations 608 and within the extension area or lug 606. The section of the outer shell 602 below the set of perforations 608 is being designated as a lower rim 624 since it will break away from the outer shell 602 and become a lower rim to provide a surface which supports the outer shell 602. As best shown in FIG. 31B, the outer shell 602 is wrapped around a downwardly tapering container 620. The outer shell 602 is secured about and/or around the container 620 when the adhesive substance 526 on the extension area or lug 606 contacts the outer surface 602*a* of the outer shell 602. The outer shell 602 is secured initially to the container 620 when the adhesive substance 526 on the area (i.e. the lower rim 624) of the outer shell 602 below set of perforations 608 contacts the container 620. After the adhesive cures, rotational force applied along the vector or arrow P-Q, breaks the set of perforations 608. Once the perforations 608 are broken, the area of the outer shell 602 below the perforation 608 remains attached to the container 620 and becomes the lower rim 624 as previously indicated. The area of the outer shell 602 above the perforation 608 is free to rotate about the container 620 while being bounded by an upper rim 622 of the container 620 and the lower rim 624 that broke away from the outer shell 602. Alternatively, if the container 620 is tapered, as shown in FIG. 31A, the outer shell 602 need not extend all the way up to the upper rim 622 of the container 620 to remain bounded, since the taper of container 620 prevents the outer shell 602 from moving towards the upper rim 622.

Figure 32A:
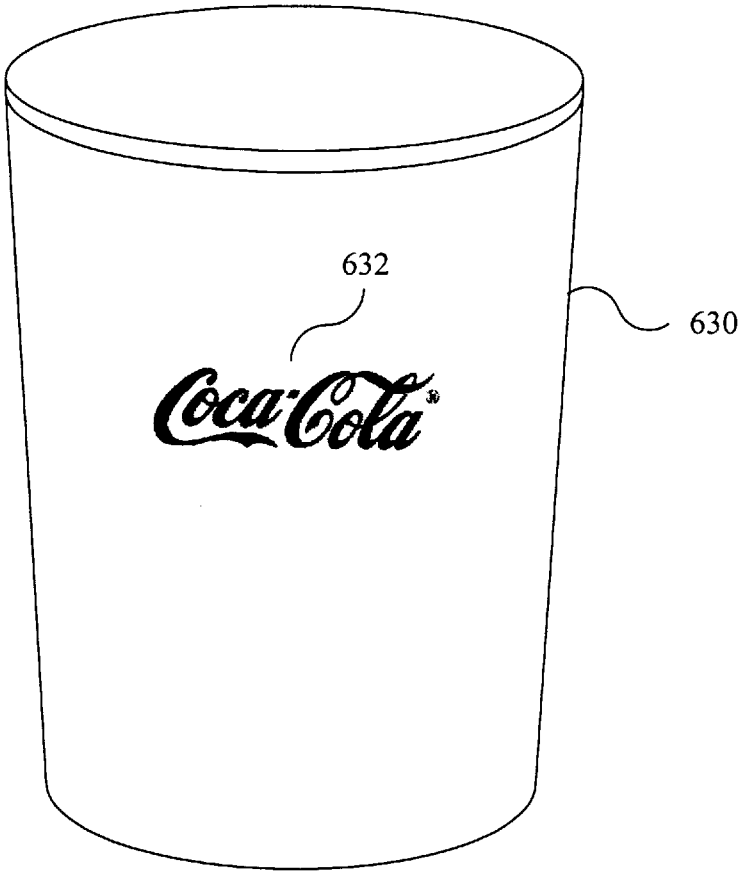
FIG. 32A is a perspective view of a container containing advertising indicia on its outer surface.
Figure 32B:
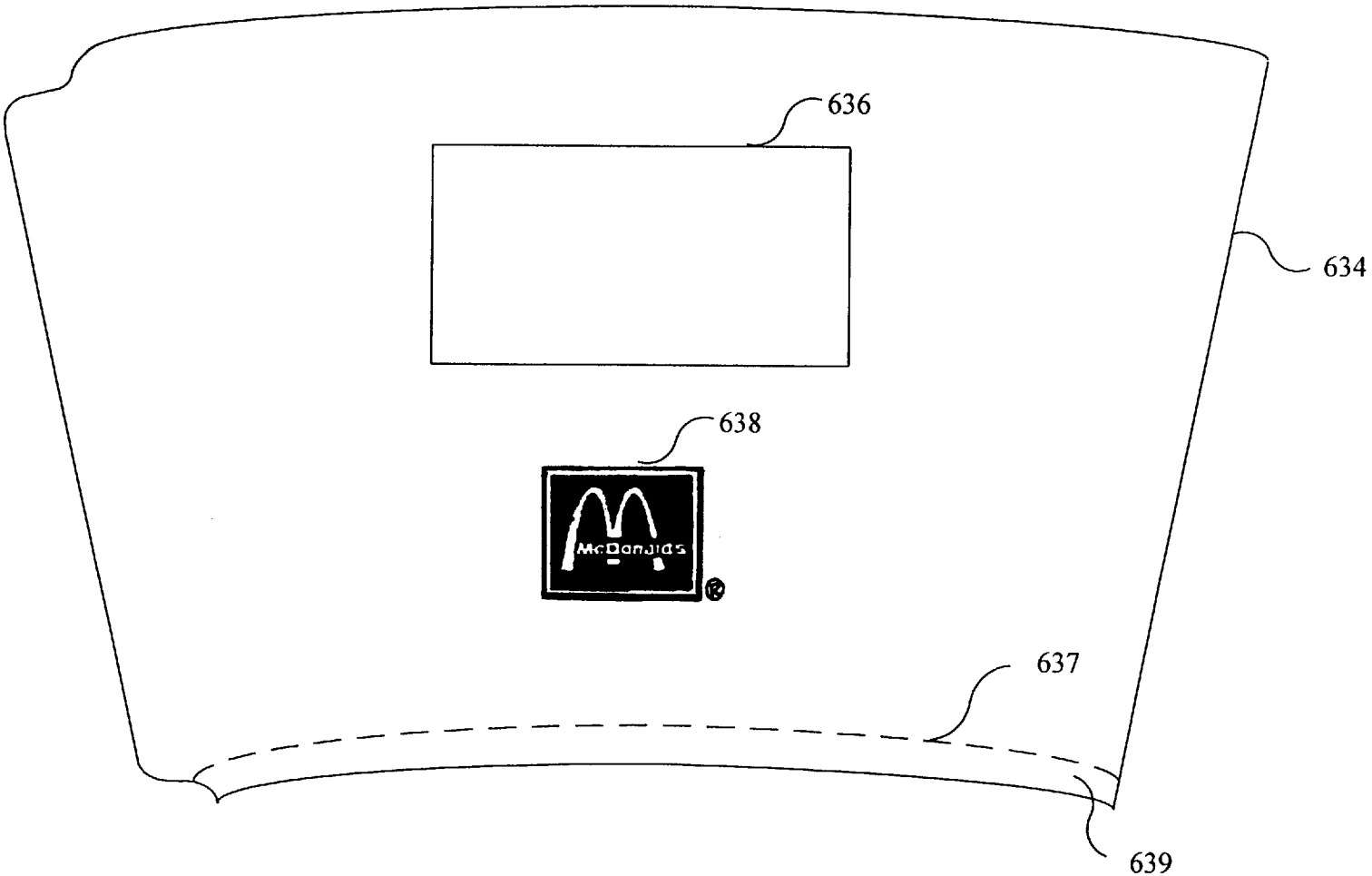
FIG. 32B is a plan view of a generally trapezoided shaped outer shell including a window or transparent region and advertising indicia.
Figure 32C:
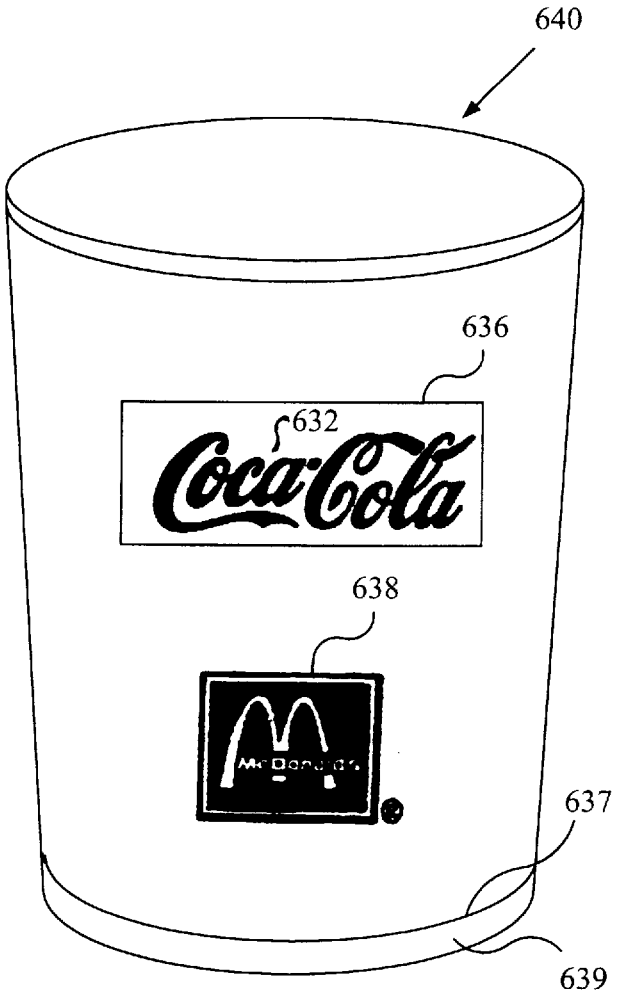
FIG. 32C is a perspective view of the outer shell of FIG. 32B disposed around the outer surface of the container of FIG. 32A.

FIG. 32A is a perspective view of a container 630 containing information 632 on its outer surface. FIG. 32B is a plan view of an outer shell 634 including a window 636, a set of structural perforations 637 below which exist a lower rim 639, and information 638. The lower rim 639 has the adhesive substance 526 on an underside (not shown) thereof to engage the container 620. More particularly and as shown in FIG. 32C, a perspective view illustrates the outer shell 634 wrapped around the container 630 in the same manner discussed with respect to FIG. 31B above. The lower rim 639 breaks away with appropriate rotational force such as vector P-Q. In this alternate embodiment 640, window 636 of the outer shell 634 allows the information 632 on the container 630 to be seen. After the set of perforations 637 are broken and the outer shell 634 is rotated, the window 636 may also reveal phrases such as "You're a Winner!" or "Sorry Try Again."

Figure 33A:
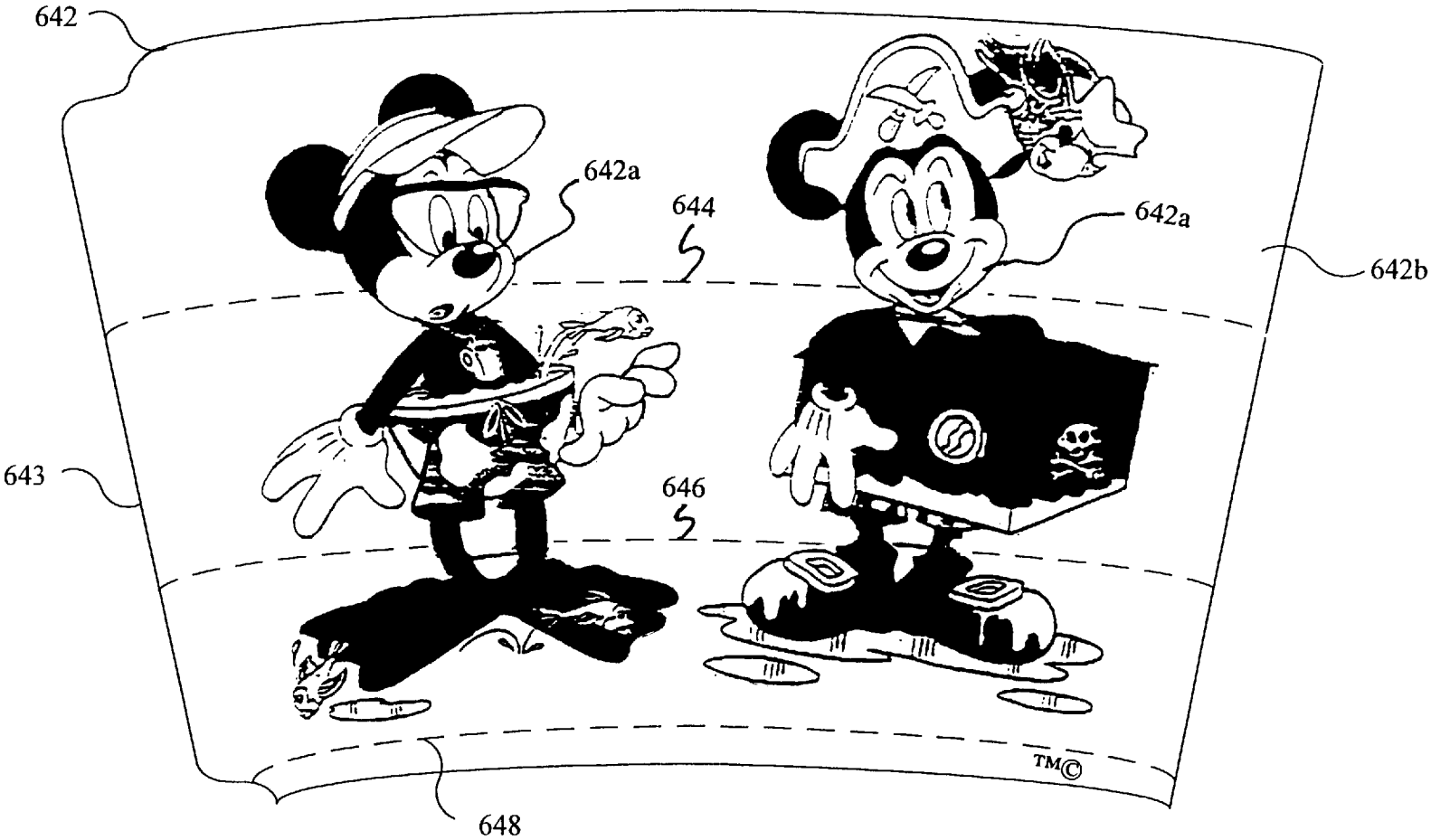
FIG. 33A is a plan view of an outside surface of an outer shell having pictorial indicia thereon and subdivided by sets of structural perforations into a first, a second, and a third segment.
Figure 33B:
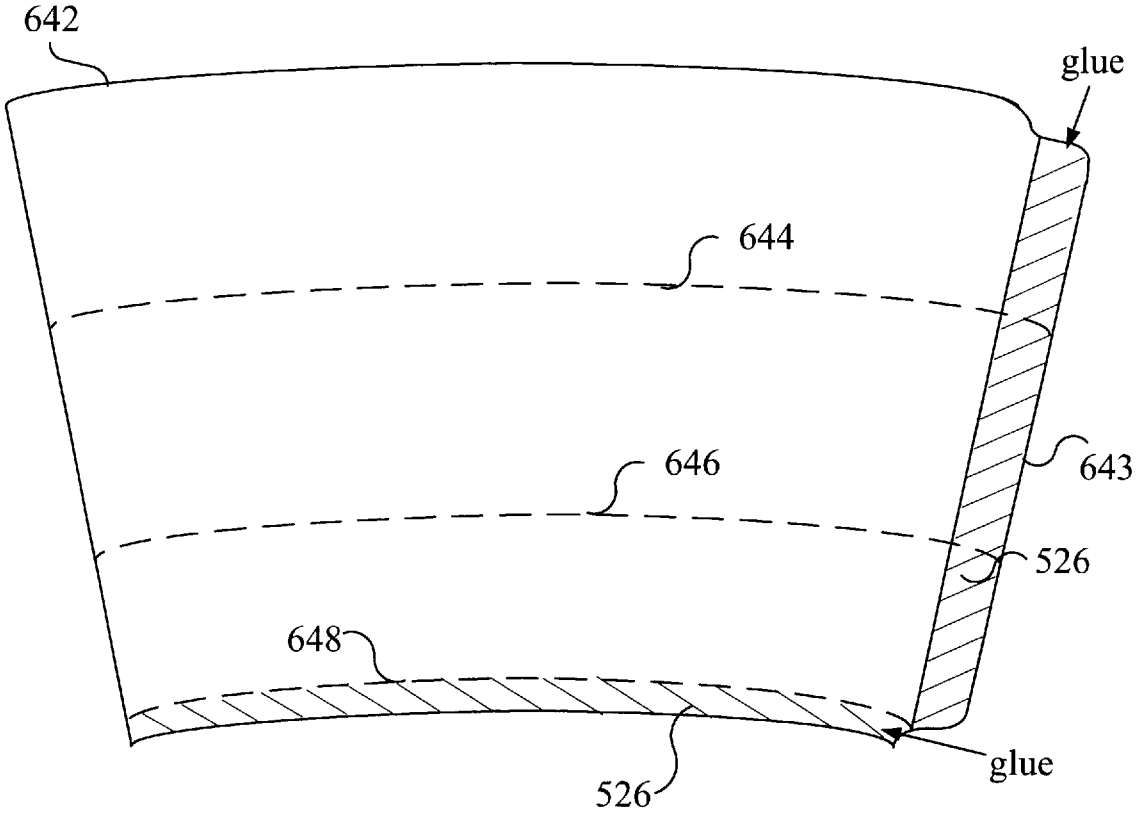
FIG. 33B is a plan view of an inside surface of the outer shell of FIG. 33A.
Figure 34A:
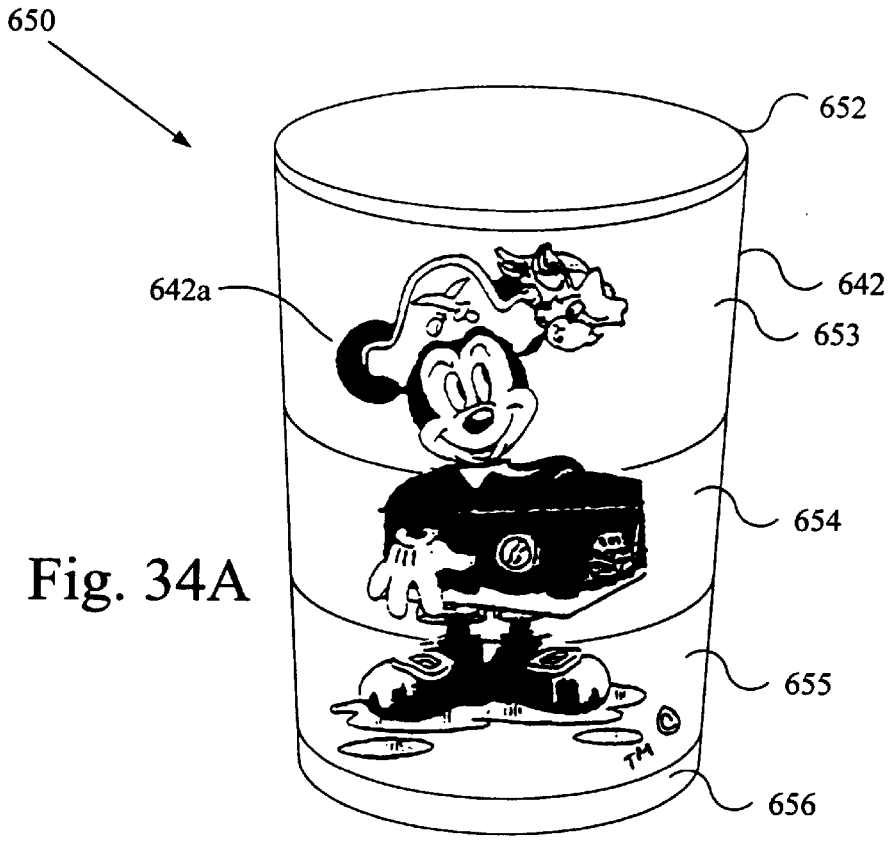
FIG. 34A is a perspective view of a container having the outer shell member of FIG. 33A disposed therearound.
Figure 34B:
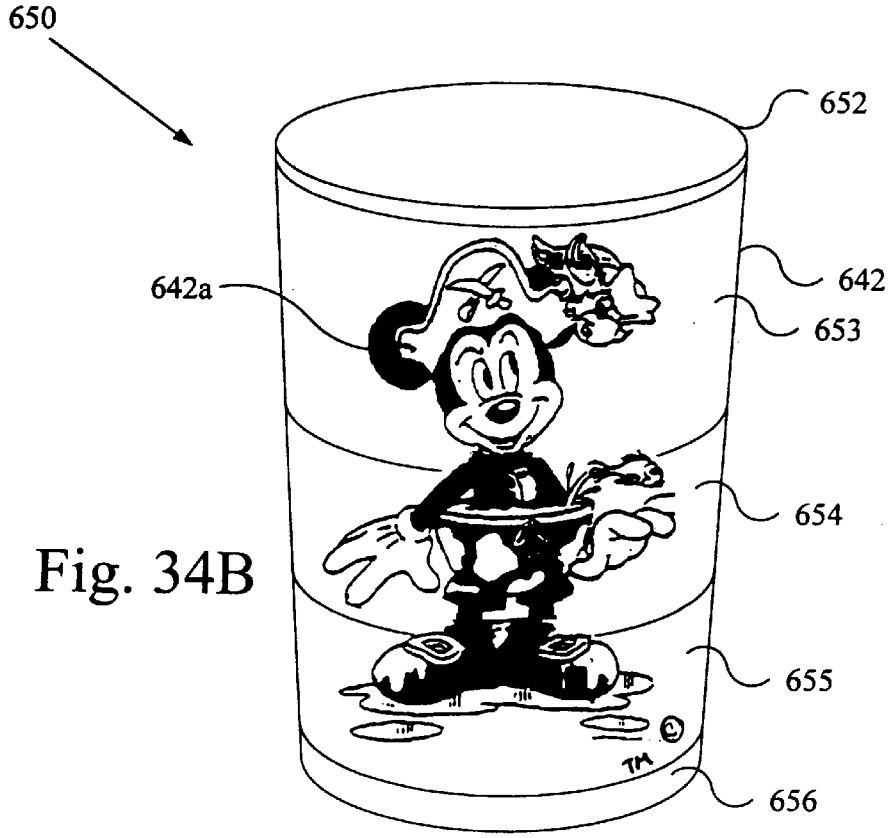
FIG. 34B is a perspective view of the embodiment of the invention in FIG. 34A where the second segment of the outer shell has been rotated into a second alignment with respect to the first and third segments.

Referring in detail now to FIGS. 33A–34B for yet another embodiment of the present invention, there is seen in FIG. 33A a plan view of an outside surface of an outer shell 642. The outer shell 602 includes an extension area 643, a first set of perforations 644, a second set of perforations 646, and a third set of perforations 648. The outside surface and the outer shell 642 includes pictorial indicia 642*a*. FIG. 33B is a plan view of an inside surface of the outer shell 642. The adhesive substance 526 is preferably applied to an area of the inside surface below the third set of perforations 648 and also to the extension area or lug 643. As best shown in FIG. 34A, the outer shell 642 is wrapped around the container 652 until the adhesive substance 526 on the extension area or lug 643 contacts an outer surface 642*b* of the outer shell 642, and until the adhesive substance 526 on the area of the outer shell 642 below the third set of perforations 648 contacts the container 652. After the adhesive cures, rotational forces break the first, second and third perforations 644, 646, 648. Once all of the sets of perforations are broken, the area of the outer shell 642 above the first set of perforations 648 becomes a first segment 655, the area of the outer shell 642 between the first set of perforations 648 and the second set of perforations 644 becomes a second segment 654, the area of the outer shell 642 above the third set of perforations 644 becomes a third segment 653, and the area of the outer shell 642 below the third set of perforation 648 remains attached to the container 652 and becomes a lower rim 656. Each of the segments 653, 654, 655 are free to independently rotate about the container 650 so that information on each of the segments 653, 654, 655 may be aligned at the discretion of a user. For instance, FIG. 34A shows the second segment 654 in a first alignment with respect to the first and third segments 655 and 653. FIG. 34B is a perspective view where the second segment 654 is in a second alignment with respect to the first and third segments 655 and 653. Those skilled in the art will recognize that the segments 653, 654, 655 may or may not have windows and may be rotated in any desired manner and in any desired sequence.

Figure 35:
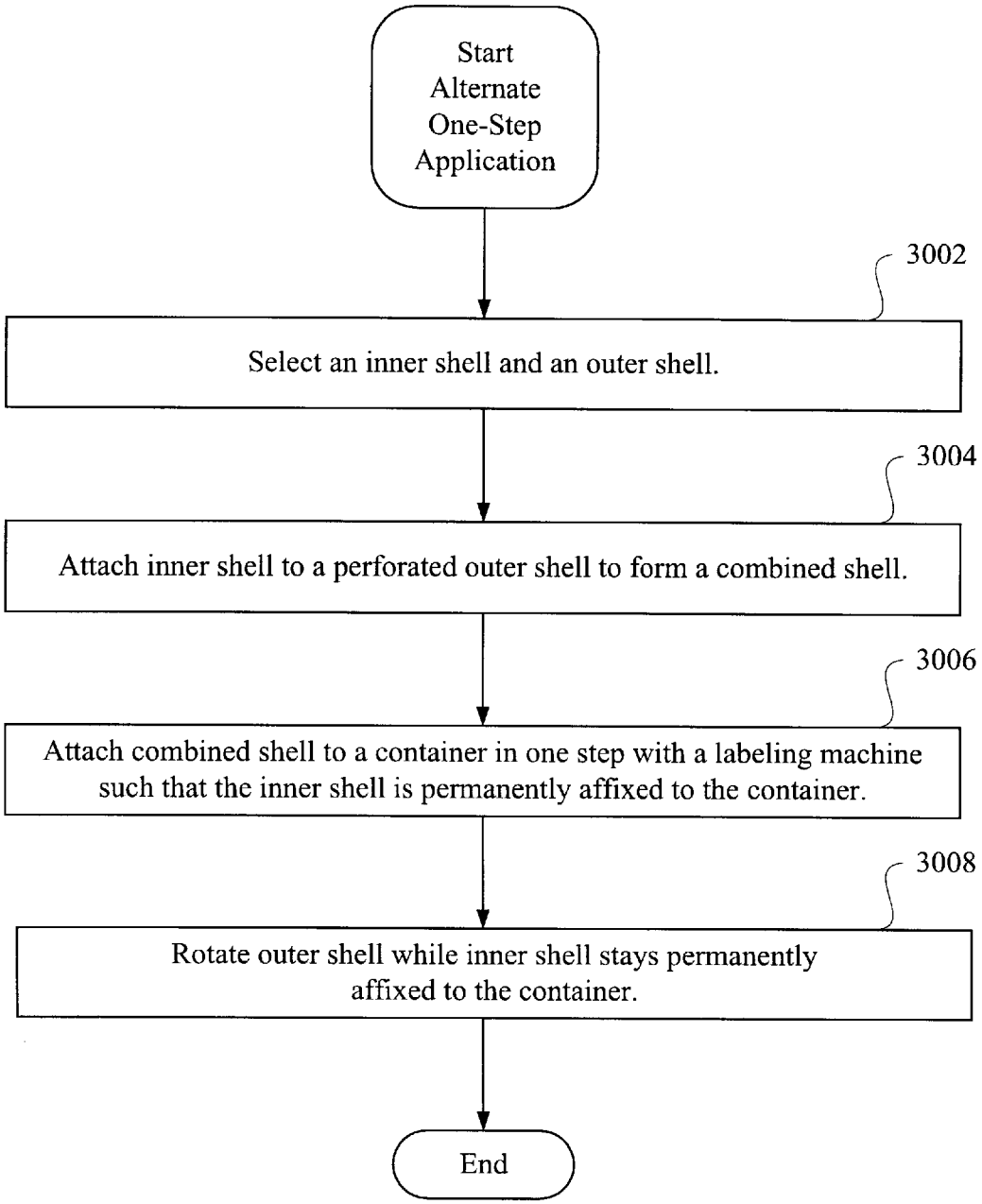
FIG. 35 is a flowchart of a method for attaching in one-step an inner shell and an outer shell to a container.

FIG. 35 is a flowchart of a method for attaching in one-step an inner shell and an outer shell to a container. In step 3002, an inner shell and an outer shell are selected for forming a label. In step 3004, the inner shell is attached to a perforated outer shell to form a combined shell. In step 3006 the labeling machine attaches the combined shell to a container in one step such that the inner shell is permanently affixed to the container. In step 3008 a user breaks the perforations by rotating the outer shell while the inner shell stays permanently affixed to the container. The embodiment of the invention shown in FIGS. 24–29 and as previously described would depict one embodiment of the immediate foregoing method performed by a labeling machine.

The invention provides other embodiments which will be apparent to those skilled in the art in light of this disclosure. For example, the foreground or background artwork could also present alphanumeric information alone or in conjunction with other types of graphic artwork. Use of alphanumeric information as foreground and background artwork 16 and 17 permits presentation device 10 to be used, for example, to conveniently provide translations of text into another language, or to supply correct medication dosages. If outer shell 14 has a transparent window area 17 as long as outer shell 14 in the direction of rotation as a line of printed text is high, then the window can be rotated to reveal one line of text at a time from inner shell 12. This allows a container label with relatively rotatable inner and outer shells to present twice the amount of text, minus one line for the window, that could be displayed on a conventional label. Further, presentation device 10 may be incorporated into a wide range of products as a unique feature of the product. Items which might incorporate the presentation device include containers such as food products or cosmetics cases, and packaging such as food, drug or candy dispensers. The device could also be incorporated into children's toys or playthings and into tools, such as flashlights, pens, markers, hair-care utensils, or silverware. In addition to purely aesthetic uses, the device can readily be used for education, entertainment, or utilitarian purposes. Therefore, the preferred embodiment disclosed herein is only one of many possible embodiments for implementing the device to present interacting elements of visual artwork. These and other variations upon, and modifications to, the preferred embodiment are intended to be covered by the present invention, which is limited only by the appended claims.

What is claimed is:

1. A rotatable label apparatus, comprising:

a container;

at least one rim member coupled to the container;

an outer shell member positioned about the container and coupled to the rim member by a set of perforations;

whereby, when the outer shell is rotated about the container, the set of perforations breaks and separates the outer shell member from the rim member, the rim member limiting longitudinal movement of the outer shell member relative to the container after the set of perforations is broken.

2. A rotatable label apparatus, comprising:

a container;

at least one rim member coupled to the container;

an outer shell member positioned about the container and coupled to the rim member by a set of perforations;

wherein the outer shell member includes a transparent region;

whereby, when the outer shell member is rotated about the container, the set of perforations breaks and separates the outer shell member from the rim member.

3. The rotatable label apparatus of claim 2 further comprising an inner shell member coupled to the container and having an inner shell surface that is capable of being seen through said transparent region of said outer shell member.

4. The rotatable label apparatus of claim 3:

wherein said container is a cylindrical container and said outer shell member is a cylindrical outer shell member disposed around said inner shell member such as to be generally coaxial with said cylindrical container.

5. The rotatable label apparatus of claim 3:

wherein said inner shell member includes an inner end portion,; and wherein the rim member is coupled to the inner end portion.

6. The rotatable label apparatus of claim 5 wherein the rim member has an inner corrugated edge and the outer shell includes an outer end portion having an outer corrugated edge, said inner corrugated edge being coupled to said outer corrugated edge to produce said set of perforations such that when the outer corrugated edge of the outer shell member is torn along said set of perforations, the rim member remains bound to said inner end portion.

7. The rotatable label apparatus of claim 6 wherein said outer shell member comprises a first outer shell end and a second outer shell end and an outer shell surface between said first outer shell end and said second outer shell end;

and a lug member bound to said second outer shell end and having an adhesive substance disposed thereon, said lug member overlapping said first outer shell end to contact said outer shell surface with said adhesive substance to engage said lug member to said outer shell surface.

8. A rotatable label apparatus which can be attached to a container, comprising:

a rim member;

an inner shell member coupled to the rim member by a set of perforations;

an outer shell member coupled to the rim members;

whereby, when the inner shell member is coupled to the container and the outer shell member is rotated about the container, the set of perforations break and separate the inner shell member from the rim member, which then supports rotation of the outer shell member.

9. The rotatable label apparatus of claim 8 wherein the outer shell member includes a transparent region.

10. The rotatable label apparatus of claim 9 wherein the inner shell member includes an inner shell surface that is capable of being seen through the transparent region of the outer shell member.

11. A rotatable label apparatus comprising:

a container;

an outer shell member having a transparent region and an outer shell structure with at least one set of structural perforations traversing the outer shell structure to form an outer side portion that may be released from said outer shell structure along said set of structural perforations, said outer side portion having a first adhesive substance disposed thereon and binding said outer side portion to said container;

said outer shell member including a first outer shell end and a second outer shell end and an outer shell surface between said first outer shell end and said second outer shell end;

a lug member bound to said second outer shell end and having a second adhesive substance disposed thereon, said lug member overlapping said first outer shell end to contact said outer shell surface with said second adhesive substance to engage said lug member to said outer shell surface.

12. A rotatable label apparatus comprising:

a container;

an outer shell member having indicia and an outer shell structure with at least one set of structural perforations traversing the outer shell structure to form an outer side portion that may be released from said outer shell structure along said set of structural perforations, said outer side portion having a first adhesive substance disposed thereon and binding said outer side portion to said container;

said outer shell member including a first outer shell end and a second outer shell end and an outer shell surface between said first outer shell end and said second outer shell end;

a lug member bound to said second outer shell end and having a second adhesive substance disposed thereon, said lug member overlapping said first outer shell end to contact said outer shell surface with said second adhesive substance to engage said lug member to said outer shell surface.

13. A rotatable label apparatus comprising:

a container;

an inner shell member secured to said container;

an outer shell member having a transparent region and an outer shell structure with at least one set of structural perforations traversing the outer shell structure to form an outer side portion that may be released from said outer shell structure along said set of structural perforations, said outer side portion having a first adhesive substance disposed thereon and binding said outer side portion to said inner shell member;

said outer shell member including a first outer shell end and a second outer shell end and an outer shell surface between said first outer shell end and said second outer shell end;

a lug member bound to said second outer shell end and having a second adhesive substance disposed thereon, said lug member overlapping said first outer shell end to contact said outer shell surface with said second adhesive substance to engage said lug member to said outer shell surface.

14. A method for constructing a rotatable label device which can be attached to a container, comprising the steps of:

perforating a first shell;

selecting a tacking substance;

attaching a second shell to the first shell with the tacking substance to form a combined shell;

attaching the combined shell to the container; and rotating the first shell so as to break the first shell free from the second shell along the set of perforations.

15. The method of claim 14, further comprising the steps of:

selecting the first shell from a set of outer shells; and selecting the second shell from a set of inner shells.

16. The method of claim 14, further comprising the steps of:

selecting the first shell from a set of inner shells; and selecting the second shell from a set of outer shells.

17. The method of claim 14, wherein the step of attaching the combined shell to the container further comprises the step of affixing the first shell to the container.

18. The method of claim 14, wherein the step of attaching the combined shell to the container further comprises the step of affixing the second shell to the container.

19. The method of claim 14, wherein the step of attaching the combined shell to the container further comprises the step of attaching the combined shell to the container in one step with a labeling machine.

20. A rotatable label which can be attached to a container, comprising:

a tubular first label layer sized to fit about the container, the first label layer including at least one rim member;

a tubular second label layer contacting the first label layer and adapted to be rotatably supported by the at least one rim member of the first label layer, the second label layer being rotatable relative to the first label layer while maintaining a substantially constant longitudinal position relative to the first label; and layer, wherein, the rim member of the first label layer further comprises at least one perforated edge connecting the first label layer to the second label layer and wherein, when the at least one perforated edge breaks the first label layer is adapted to rotate relative to the second label layer.

21. The rotatable label of claim 20, wherein the second label layer further comprises a transparent window.

22. A rotatable label, which can be attached to a container, comprising:

a tubular first label layer sized to fit about the container, the first label layer including at least one rim member; and a tubular second label layer contacting the first label layer and adapted to be rotatably supported by the at least one rim member of the first label layer;

wherein the rim member of the first label layer further comprises at least one perforated edge connecting the first label layer to the second label layer, wherein, when the at least one perforated edge breaks the first label layer is adapted to rotate relative to the second label layer.

* * * * *